US007639183B2

(12) United States Patent
Teshirogi et al.

(10) Patent No.: US 7,639,183 B2
(45) Date of Patent: Dec. 29, 2009

(54) CIRCULARLY POLARIZED ANTENNA AND RADAR DEVICE USING THE SAME

(75) Inventors: Tasuku Teshirogi, Tokyo (JP); Aya Hinotani, Atsugi (JP)

(73) Assignees: Anritsu Corporation, Atsugi-Shi (JP); Matsushita Electric Industrial Co., Ltd., Kadoma-Shi (JP)

( * ) Notice: Subject to any disclaimer, the term of this patent is extended or adjusted under 35 U.S.C. 154(b) by 538 days.

(21) Appl. No.: 10/585,832

(22) PCT Filed: Nov. 14, 2005

(86) PCT No.: PCT/JP2005/020859

§ 371 (c)(1),
(2), (4) Date: Jul. 12, 2006

(87) PCT Pub. No.: WO2006/051947

PCT Pub. Date: May 18, 2006

(65) Prior Publication Data

US 2008/0231541 A1 Sep. 25, 2008

(30) Foreign Application Priority Data

Nov. 15, 2004 (JP) ..... 2004-331031

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/711, 343/700 MS, 895, 846

See application file for complete search history.

(56) References Cited

U.S. PATENT DOCUMENTS 4,367,475 A 1/1983 Schiavone (Continued)

FOREIGN PATENT DOCUMENTS

FR 2 835 972 A1 8/2003

(Continued)

OTHER PUBLICATIONS

FCC 02-48 New Part 15 Rules; First Report and Order; pp. 2-4; 72-78; 103-116; Apr. 2002.

(Continued)

*Primary Examiner*—Shih-Chao Chen
(74) *Attorney, Agent, or Firm*—Frishauf, Holtz, Goodman & Chick, P.C.

(57) ABSTRACT

A circularly polarized antenna has a dielectric substrate, a ground conductor piled up on one surface side of the dielectric substrate, a circularly polarized antenna element formed on an opposite surface of the dielectric substrate, a plurality of metal posts whose respective one end sides are connected to the ground conductor and penetrate the dielectric substrate along a thickness direction thereof, and whose respective other sides extend up to the opposite surface of the dielectric substrate, the plurality of metal posts configuring a cavity by being provided at predetermined intervals so as to surround the antenna element, and a conducting rim which short-circuits the respective other end sides of the plurality of metal posts along an array direction thereof, and is provided so as to extend by a predetermined distance in a direction of the antenna element at the side of the opposite surface of the dielectric substrate.

24 Claims, 17 Drawing Sheets

U.S. PATENT DOCUMENTS

| | | | | |
|---|---|---|---|---|
| 5,268,695 | A | 12/1993 | Dentinger et al. | |
| 5,712,647 | A * | 1/1998 | Shively | 343/895 |
| 6,150,989 | A | 11/2000 | Aubry | |
| 6,181,279 | B1 * | 1/2001 | Van Hoozen | 343/700 MS |
| 6,218,610 | B1 | 4/2001 | Suzuki | |
| 6,624,787 | B2 | 9/2003 | Puzella et al. | |
| 6,768,469 | B2 | 7/2004 | Hager et al. | |
| 6,801,167 | B2 * | 10/2004 | Shibata | 343/700 MS |
| 6,839,032 | B2 | 1/2005 | Teshirogi et al. | |
| 7,079,078 | B2 * | 7/2006 | Yuanzhu | 343/700 MS |
| 2004/0012529 | A1 | 1/2004 | Teshirogi et al. | |
| 2005/0128144 | A1 | 6/2005 | Himmelstoss et al. | |

FOREIGN PATENT DOCUMENTS

| | | | |
|---|---|---|---|
| JP | 58-026282 | A | 2/1983 |
| JP | 3-267804 | A | 11/1991 |
| JP | 10-319117 | A | 12/1998 |
| JP | 11-17377 | A | 1/1999 |
| JP | 11-308044 | A | 11/1999 |
| JP | 2000-138525 | A | 5/2000 |
| JP | 2001-251132 | A | 9/2001 |
| JP | 2002-124592 | A | 4/2002 |
| JP | 2005-525735 | A | 8/2005 |
| WO | WO 03/021824 | A1 | 3/2003 |
| WO | WO 03/030301 | A1 | 4/2003 |
| WO | WO 03/058758 | A1 | 7/2003 |
| WO | WO 03/067709 | A1 | 8/2003 |

OTHER PUBLICATIONS

FCC 04-285; Second Report and Order and Second Memorandum Opinion and Order; pp. 20-21; Dec. 16, 2004.

T. Teshirogi et al; Residual-Carrier Free Burst Oscillator for Automative UWB Radar Applications; Electronics Letters, Apr. 2005; vol. 41, No. 9.

H. Nakano et al; Tilted and Axial Beam Formation by a Single Arm Rectangular Spiral Antenna With Compact Dielectric Substrate and Conduting Plane; IEEE; Trans. AP, vol. 50, No. 1, pp. 17-23; Jan. 2002.

T. Teshirogi et al; Wideband Circularly Polarized Array Antenna With Sequential Rotations and Phase Shift of Elements; Proc. of ISAP'85; 024-3; pp. 117-120; 1985.

Notification Concerning Transmittal of International Preliminary Report on Patentability, Chapter I of the Patent Cooperation Treaty, and Written Opinion of the International Searching Authority, Dated May 15, 2007 for PCT/JP2005/020859, 5 sheets.

Japanese Office Action (and English translation thereof) dated Jul. 15, 2008, issued in a counterpart Japanese Application.

Japanese Office Action dated Mar. 3, 2009 (2 pages), and English translation thereof (3 pages) issued in counterpart Japanese Application No. 2006-520457.

* cited by examiner

CIRCULARLY POLARIZED ANTENNA AND RADAR DEVICE USING THE SAME

This application is a U.S. National Phase Application under 35 USC 371 of International Application PCT/JP2005/020859 filed Nov. 14, 2005.

TECHNICAL FIELD

The present invention relates to a circularly polarized antenna which uses a technology for realizing high-efficiency, high-mass productivity and low-cost manufacturing, and a radar device using the same, and in particular, to a circularly polarized antenna which is suitable for ultra-wide-band (UWB) radars used as automotive radars, and a radar device using the same.

BACKGROUND ART

It has been proposed to use UWB using a quasi-millimeter waveband of 22 to 29 GHz as automotive radars or portable short range radars (SRR).

As an antenna of a radar device used within the UWB, not only a radiation characteristic thereof must be a wideband, but also it is necessary for the antenna to have a compact size and a thin, flat structure in consideration of the fact that it is provided, for example, in a gap between a vehicle body and a bumper at the time of being mounted on a vehicle.

Further, as this antenna, low-loss and high-gain are required in order to carry out exploration with weak radio waves specified by the UWB, and to suppress wasteful electricity consumption so as to be battery-driven, and therefore, it is necessary for the antenna to be easily set in an array.

Furthermore, as this antenna, it is desirable that a feed unit for antenna elements can be manufactured by a printing technology in order to realize low-cost manufacturing.

Moreover, as regards radars, it is desired to use circular polarization whose cross polarization component is small in order to be free of the influence of a secondary reflected wave.

As described above, a band of 22 to 29 GHz is to be used for UWB radars. However, a RR prohibited band (23.6 to 24.0 GHz) for protecting passive sensors of radio astronomical or earth exploration-satellite services (EESS) is included in this band.

In 2002, the FCC (Federal Communications Commission) of USA has disclosed the rule that an average power density is −41.3 dBm or less, and a peak power density is 0 dBm/50 MH at 22 to 29 GHz in the following Non-Pat. Document 1.

In this rule, it is stipulated that a wave angle side lobe is reduced to be −25 dB to −35 dB every several years in order to suppress radio interference onto the aforementioned EESS as well.

Non-Pat. Document 1: FCC 02-48 New Part 15 Rules, FIRST REPORT AND ORDER

However, in order to achieve this, a dimension in a vertical direction of an antenna for use in a UWB radar is made larger, and it is assumed that it is difficult to mount the antenna onto a general passenger vehicle.

Therefore, the FCC has added the revised rule that a radiation power density within the RR prohibited band is −61.3 dBm/MHz, which is 20 dB less than the previous one, in the following Non-Pat. Document 2 in 2004, as a method for not depending on a side lobe of an antenna.

Non-Pat. Document 2: "Second Report and Order and Second Memorandum Opinion and Order" FCC 04-285, Dec. 16, 2004

In a conventional UWB radar, a system has been used in which a continuous wave (CW) from a continuous wave oscillator is turned on/off by a semiconductor switch.

In this system, a large residual carrier occurs due to the incompleteness in isolation of the switch. For this reason, as shown by the broken line in FIG. 21, the aforementioned residual carrier is evacuated into a short range device (SRD) band of 24.05 to 24.25 GHz which is allocated for a Doppler radar.

However, there is the serious problem that the SRD band is extremely close to the aforementioned RR prohibited band, which brings about unavoidable interference with the EESS or the like.

In order to solve the problem, there has been proposed a method in which a burst oscillator shown in the following Non-Pat. Document 3 is used for a UWB radar.

Non-Pat. Document 3: "Residual-carrier free burst oscillator for automotive UWB radar applications", Electronics Letters, 28 Apr. 2005, Vol. 41, No. 9

The burst oscillator oscillates only when a pulse is in an on-state, and stops oscillation when a pulse is in an off-state. A residual carrier does not occur when such a burst oscillator is used for the UWB radar.

Accordingly, an arbitrary spectral array is possible, and a frequency band as shown by the solid line in FIG. 21 can be used for the UWB radar. As a result, it is possible to suppress a radiation power density within the RR prohibited band to be sufficiently low.

However, it is not easy to reduce by 20 dB or more in the above-described radiation power density from a spectral peak through sole use of the burst oscillator.

In this case, if the antenna has a characteristic with a sharp notch in gain within the above-described RR prohibited band, the UWB radar satisfying the new rule of the FCC can be realize by using this antenna in combination with the aforementioned burst oscillator.

The present invention is designed to provide such an antenna suitable for the UWB radar, the antenna having a notch in gain within the RR prohibited band.

As an antenna for satisfying these requests, first of all, it is necessary to realize a wideband thin, flat antenna.

As a thin, flat antenna, a so-called patch antenna configured such that rectangular or circular tabular antenna elements are formed in a pattern on a dielectric substrate has been known.

However, this patch antenna is generally a narrow band type, and in order for this to be a wideband type, it is necessary to use a substrate with a low dielectric constant, and to make a thickness thereof larger.

Further, a low-loss substrate is necessary for being used within a quasi-millimeter waveband, and Teflon (registered trademark) has been known as such a substrate.

However, because Teflon has a drawback in joining of metal films, it is difficult to manufacture an antenna, which brings about the problem of high cost.

In addition, as a wideband circularly polarized antenna, one in which spiral antenna elements are provided on a relatively thick dielectric substrate has been reported in the following Non-Pat. Document 4.

Non-Pat. Document 4: Nakano et al. "Tilted-and Axial-Beam Formation by a Single-Arm Rectangular Spiral Antenna With Compact Dielectric Substrate and Conducting Plane", IEEE Trans. AP, vol. 50, No. 1, pp. 17-23 Jan. 2002

A spiral antenna is generally a balanced type antenna having a pair of spiral elements.

However, in the above-described Non-Pat. Document 4, the antenna is configured by one spiral element, which makes it possible to unbalanced feed that no use a balun.

DISCLOSURE OF INVENTION

However, in the case of the antenna in the Non-Pat. Document 4, a size of a dielectric is about λ/2, and when it is made to have an array structure, a plurality of blocks of the dielectrics must be set in array at constant distances, and it is not structurally suitable for mass production.

Further, it is possible to arrange a plurality of spiral elements on a shared dielectric substrate. However, as described above, when a thickness of the dielectric substrate is large (a thickness which is unignorable as compared with a wavelength), a surface wave propagating along the surface of the dielectric substrate is excited, and the respective elements are affected one another by the surface wave, which makes it impossible to obtain a desired characteristic.

Note that, this surface wave is generated by increasing a thickness of the substrate in order to have a wideband even in the case of the patch antenna described above.

An object of the present invention is to provide a circularly polarized antenna which suppresses the influence due to a surface wave as described above, has a favorable radiation characteristic over a wideband, and suppresses a radiation within an RR prohibited band, which makes it possible to realize high-mass productivity and low-cost manufacturing, and a radar device using the same.

In order to achieve the above object, according to a first aspect of the present invention, there is provided a circularly polarized antenna comprising:

a dielectric substrate (21, 21', 21");

a ground conductor (22, 22') which is piled up one surface side of the dielectric substrate;

a circularly polarized type of antenna element (23, 23') formed on an opposite surface of the dielectric substrate;

a plurality of metal posts (30) whose respective one end sides are connected to the ground conductor and penetrate the dielectric substrate along a thickness direction thereof, and whose respective other end sides extend up to the opposite surface of the dielectric substrate, the plurality of metal posts configuring a cavity by being provided at predetermined intervals so as to surround the antenna element; and a conducting rim (32, 32') which short-circuits the respective other end sides of the plurality of metal posts along an array direction thereof, and is provided so as to extend by a predetermined distance in a direction of the antenna element at the side of the opposite surface of the dielectric substrate.

In order to achieve the above object, according to a second aspect of the present invention, there is provided the circularly polarized antenna according to the first aspect, wherein the antenna element has a predetermined polarization rotation direction, and is formed of a square-shaped spiral type or a circular spiral type having a central side end portion of a spiral, and the circularly polarized antenna further comprises a feed pin (25) whose one end side is connected to the central side end portion of the spiral of the antenna element formed of the square-shaped spiral type or circular spiral type, the feed pin being provided so as to penetrate the dielectric substrate and the ground conductor.

In order to achieve the above object, according to a third aspect of the present invention, there is provided the circularly polarized antenna according to the second aspect, wherein the antenna element which is formed on the dielectric substrate and the feed pin whose one end side is connected to the central side end portion of the spiral of the antenna element are provided to be respectively in plural sets, the predetermined polarization rotation directions of the plural sets of antenna elements are respectively formed so as to be identical polarization rotation direction, the plurality of metal posts configuring the cavities and the conducting rim are formed in a lattice shape so as to surround the plural sets of antenna elements of, and the circularly polarized antenna further comprises a feed unit (40) to distribute and supply excitation signals to the plural sets of antenna elements via the plural sets of feed pins, the feed unit being provided at a side of the ground conductor.

In order to achieve the above object, according to a fourth aspect of the present invention, there is provided the circularly polarized antenna according to the third aspect, wherein the feed unit is configured by a feeding dielectric substrate (41) provided at a side opposite to the dielectric substrate so as to sandwich the ground conductor, and a microstrip type of feeding line (42) formed on a surface of the feeding dielectric substrate.

In order to achieve the above object, according to a fifth aspect of the present invention, there is provided the circularly polarized antenna according to the third aspect, wherein the plural sets of antenna elements are formed so as to have at least two types of different array angles of identical array angle and different array angles from one another respectively around axes perpendicular to the opposite surface of the dielectric substrate, and among the plural sets of antenna elements, the feed unit distributes and supplies the excitation signals among the respective antenna elements having the identical array angle in-phase, and distributes and supplies the excitation signals among the respective antenna elements having the different array angles such that respective main polarization components are in-phase and respective cross polarization components are out of phase.

In order to achieve the above object, according to a sixth aspect of the present invention, there is provided the circularly polarized antenna according to the second aspect, wherein the antenna element formed of the square-shaped spiral type is formed as a square-shaped spiral type of antenna element with a predetermined number of turns which are interlinked with one another in a square-shaped spiral form configured such that, assuming that a basic length is a0 with a predetermined element width W, lines having lengths of the a0 and integer multiples of the a0 are arranged at each angle of 90°.

In order to achieve the above object, according to a seventh aspect of the present invention, there is provided the circularly polarized antenna according to the second aspect, wherein the antenna element formed of the circular spiral type is formed as a circular spiral type of antenna element having a predetermined number of turns which are interlinked with one another in a circular spiral form with a predetermined element width W at a predetermined spiral interval d, and with a predetermined radius initial value SR from a reference point.

In order to achieve the above object, according to an eighth aspect of the present invention, there is provided the circularly polarized antenna according to the first aspect, wherein as the antenna element, first circularly polarized type of antenna elements (23, 23') having a predetermined polarization rotation direction, and second circularly polarized type of antenna elements (23', 23) having a polarization rotation direction in a direction opposite to the predetermined polarization rotation direction are formed on the dielectric substrate (21"), the plurality of metal posts (30), whose respective one end sides are connected to the ground conductor and penetrate the dielectric substrate along a thickness direction thereof, and whose respective other end sides extend up to the opposite surfaces of the dielectric substrate, respectively configure isolated cavities by being provided at predetermined intervals so as to surround the first circularly polarized type of antenna elements and the second circularly polarized type of antenna elements in isolation, and as the conducting rim (32, 32'), a first conducting rim (32) and a second conducting rim (32'), which respectively short-circuit the respective other end sides of the plurality of metal posts which are respectively provided at predetermined intervals so as to surround the first circularly polarized type of antenna elements and the second circularly polarized type of antenna elements in isolation along array directions thereof, are provided on the opposite surface side of the dielectric substrate so as to extend by a predetermined distance in directions of the first circularly polarized type of antenna elements and the second circularly polarized type of antenna elements.

In order to achieve the above object, according to a ninth aspect of the present invention, there is provided the circularly polarized antenna according to the eighth aspect, wherein one of the first circularly polarized type of antenna elements and the second circularly polarized type of antenna elements is applied as a transmitting antenna (51) of a radar device (50), and another of the first circularly polarized type of antenna elements and the second circularly polarized type of antenna elements is applied as a receiving antenna (52) of the radar device (50).

In order to achieve the above object, according to a tenth aspect of the present invention, there is provided the circularly polarized antenna according to any one of the first to ninth aspects, wherein a resonator is configured by the cavities and the conducting rims, and structural parameters of the resonator and the antenna elements are adjusted to set a resonant frequency of the resonator to a desired value, whereby a frequency characteristic is obtained in which a gain of the circularly polarized antenna declines within a predetermined range.

In order to achieve the above object, according to an eleventh aspect of the present invention, there is provided the circularly polarized antenna according to the tenth aspect, wherein the structural parameters include at least one of an inside dimension Lw of the cavity, a rim width $L_R$ Of the conducting rim, the number of turns of the antenna element, a basic length a0 of the antenna element, and a line width W of the antenna element.

In order to achieve the above object, according to a twelfth aspect of the present invention, there is provided a radar device (50) comprising:

a transmitting unit (54) which radiates a radar pulse into a space via a transmitting antenna (51);

a receiving unit (55) which receives via a receiving antenna (52) a reflected wave of the radar pulse returned from the space;

an analysis processing unit (56) which explores an object existing in the space based on a reception output from the receiving unit; and a control unit (53) which controls at least one of the transmitting unit and the receiving unit based on an output from the analysis processing unit, wherein the receiving antenna and the transmitting antenna are configured by first circularly polarized type of antenna elements (23, 23') having a predetermined polarization rotation direction and second circularly polarized type of antenna elements (23', 23) having a polarization rotation direction in a direction opposite to the predetermined polarization rotation direction, the first and second circularly polarized type of antenna elements each comprising:

a dielectric substrate (21, 21', 21");

a ground conductor (22, 22") which is piled up one surface side of the dielectric substrate;

a circularly polarized type of antenna element (23, 23') formed onto an opposite side of the dielectric substrate;

a plurality of metal posts (30) whose respective one end sides are connected to the ground conductor and penetrate the dielectric substrate along a thickness direction thereof, and whose respective other end sides extend up to the opposite surface of the dielectric substrate, the plurality of metal posts configuring cavities by being provided at predetermined intervals so as to surround the antenna element; and a conducting rim (32, 32') which short-circuits the respective other end sides of the plurality of metal posts along array directions thereof, and is provided so as to extend by a predetermined distance in the direction of the antenna element at the opposite surface side of the dielectric substrate, the plurality of metal posts (30), whose respective one end sides are connected to the ground conductor and penetrate the dielectric substrate along a thickness direction thereof, and whose respective other end sides extend up to the opposite surface of the dielectric substrate, respectively configure isolated cavities by being provided at predetermined intervals so as to surround the first circularly polarized type of antenna elements and the second circularly polarized type of antenna elements in isolation, and as the conducting rim (32, 32'), a first conducting rim (32) and a second conducting rim (32'), which short-circuit the respective other end sides of the plurality of metal posts which are respectively provided at predetermined intervals so as to surround the first circularly polarized type of antenna elements and the second circularly polarized type of antenna elements in isolation along array directions thereof, are provided on the opposite surface side of the dielectric substrate so as to extend by a predetermined distance in the directions of the first circularly polarized type of antenna elements and the second circularly polarized type of antenna elements.

In order to achieve the above object, according to a thirteenth aspect of the present invention, there is provided the radar device (50) according to the twelfth aspect, wherein the antenna element has a predetermined polarization rotation direction, and is formed of a square-shaped spiral type or a circular spiral type having a central side end portion of a spiral, and the radar device further comprises a feed pin (25) whose one end side is connected to the central side end portion of the spiral of the antenna element formed of the square-shaped spiral type or circular spiral type, the feed pin being provided so as to penetrate the dielectric substrate and the ground conductor.

In order to achieve the above object, according to a fourteenth aspect of the present invention, there is provided the radar device (50) according to the thirteenth aspect, wherein the antenna element which is formed on the dielectric substrate and the feed pin whose one end side is connected to the central side end portion of the spiral of the antenna element are provided to be respectively in plural sets, the predetermined polarization rotation directions of the plural sets of antenna elements are respectively formed so as to be identical polarization rotation direction, the plurality of metal posts configuring the cavities and the conducting rim are formed in a lattice shape so as to surround the plural sets of antenna elements, and the radar device further comprises a feed unit (40) to distribute and supply excitation signals to the plural sets of antenna elements via the plural sets of feed pins, the feed unit being provided at a side of the ground conductor.

In order to achieve the above object, according to a fifteenth aspect of the present invention, there is provided the radar device (50) according to the fourteenth aspect, wherein the feed unit is configured by a feeding dielectric substrate (41) provided at a side opposite to the dielectric substrate so as to sandwich the ground conductor, and a microstrip type of feeding line (42) formed on a surface of the feeding dielectric substrate.

In order to achieve the above object, according to a sixteenth aspect of the present invention, there is provided the radar device (50) according to the fourteenth aspect, wherein the plural sets of antenna elements are formed so as to have at least two types of different array angles of identical array angle and different array angles from one another respectively around axes perpendicular to the opposite surface of the dielectric substrate, and among the plural sets of antenna elements, the feed unit distributes and supplies the excitation signals among the respective antenna elements having the identical array angle in-phase, and distributes and supplies the excitation signals among the respective antenna elements having the different array angles such that respective main polarization components are in-phase and respective cross polarization components are out of phase.

In order to achieve the above object, according to a seventeenth aspect of the present invention, there is provided the radar device (50) according to the thirteenth aspect, wherein the antenna element formed of the square-shaped spiral type is formed as a square-shaped spiral type of antenna element with a predetermined number of turns which are interlinked with one another in a square-shaped spiral form configured such that, assuming that a basic length is a0 with a predetermined element width W, lines having lengths of the a0 and integer multiples of the a0 are arranged at each angle of 90°.

In order to achieve the above object, according to an eighteenth aspect of the present invention, there is provided the radar device (50) according to the thirteenth aspect, wherein the antenna element which is formed of the circular spiral type is formed as a circular spiral type of antenna element having a predetermined number of turns which are interlinked with one another in a circular spiral form with a predetermined element width W at a predetermined spiral interval d, and with a predetermined radius initial value SR from a reference point.

In order to achieve the above object, according to a nineteenth aspect of the present invention, there is provided the radar device (50) according to any one of the twelfth to eighteenth aspects, wherein a resonator is configured by the cavities and the conducting rims, and structural parameters of the resonator and the antenna elements are adjusted to set a resonant frequency of the resonator to a desired value, whereby a frequency characteristic is obtained in which a gain of the circularly polarized antenna declines within a predetermined range.

In order to achieve the above object, according to a twentieth aspect of the present invention, there is provided the radar device (50) according to the nineteenth aspect, wherein the structural parameters include at least one of an inside dimension Lw of the cavity, a rim width $L_R$ of the conducting rim, the number of turns of the antenna element, a basic length a0 of the antenna element, and a line width W of the antenna element.

In the circularly polarized antenna of the invention configured as described above, a cavity structure is formed such that metal posts penetrating the dielectric substrate are arranged so as to surround antenna elements. Moreover, rims/conducting rims which short-circuit the tips of the metal posts along the array direction, and which extend by a predetermined distance in the direction of the antenna elements are provided. Consequently, a surface wave can be prevented from being generated, which can provide an antenna with the desired radiation characteristic.

Further, in the circularly polarized antenna of the invention, a frequency characteristic of antenna gain can be provided with a sharp notch within the RR prohibited band by utilizing a resonance of the cavities, which is effective for reducing radio interference with the EESS described above.

Moreover, in the circularly polarized antenna of the invention, sequential rotation array calibration, i.e., in which a plurality of antenna elements are arranged at least two types of angles around axes, is possible. Excitation signals are distributed to supply such that, among the plurality of antenna elements, respective antenna elements having a same array angle are made to be in-phase while respective main polarization components are made to be in-phase and respective cross polarization components are made to be out of phase among respective antenna elements having different array angles. As a consequence, the cross polarization components of the respective antenna elements are balanced out, and it is possible to realize a favorable circular polarization characteristic over a wideband and a favorable reflection characteristic over a wideband.

BEST MODE FOR CARRYING OUT THE INVENTION

Hereinafter, several embodiments of the present invention will be described with reference to the drawings.

First Embodiment

FIGS. 1 to 5 show a basic structure of a circularly polarized antenna 20 according to a first embodiment to which the present invention is applied.

Figure 1:
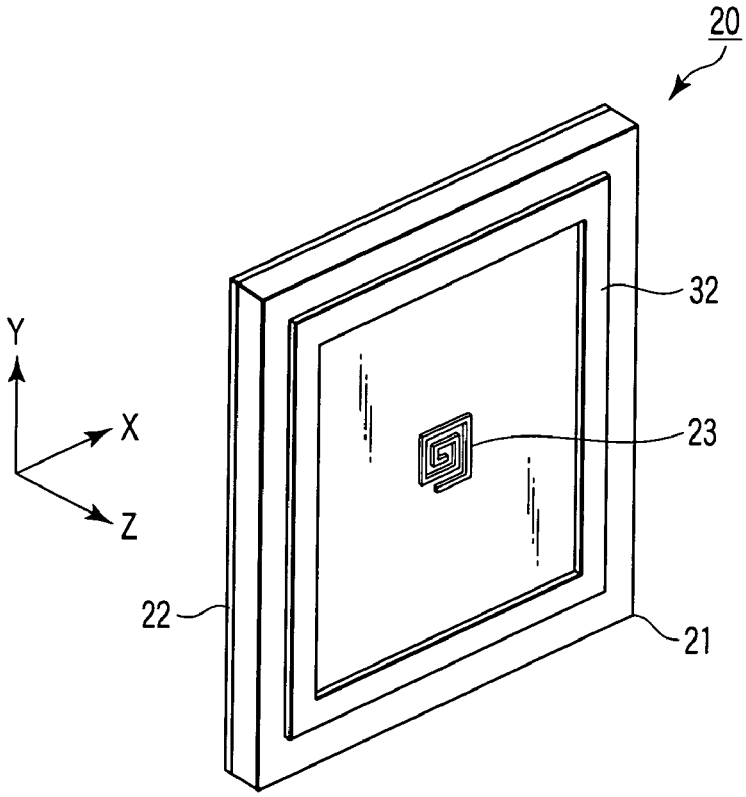
FIG. 1 is a perspective view for explaining a configuration of a first embodiment of a circularly polarized antenna according to the present invention.

Namely, FIG. 1 is a perspective view for explaining a configuration of the first embodiment of the circularly polarized antenna according to the invention.

Figure 2:
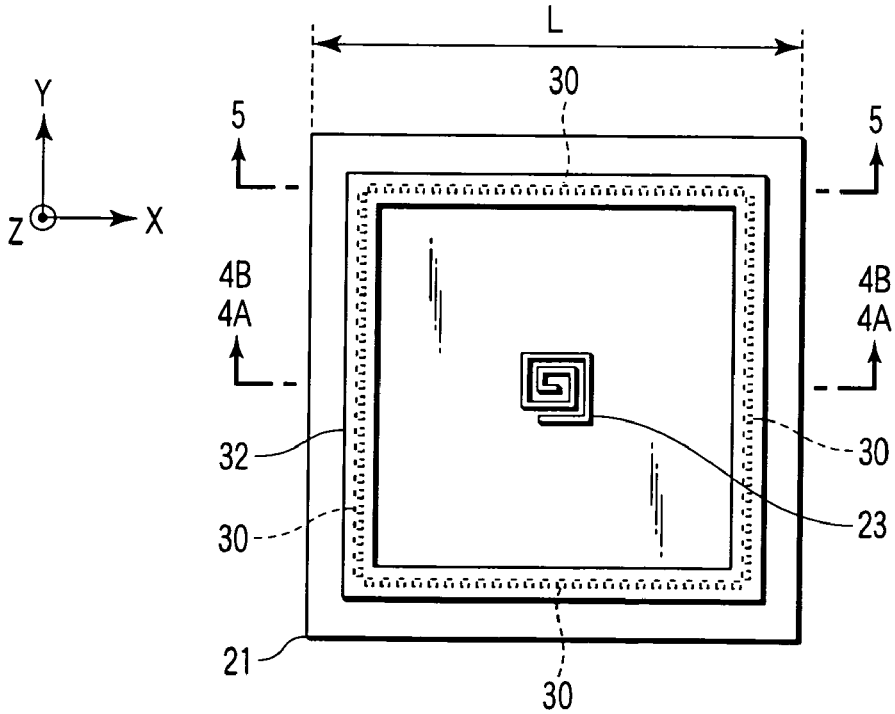
FIG. 2 is a front view for explaining the configuration of the first embodiment of the circularly polarized antenna according to the invention.

FIG. 2 is a front view for explaining the configuration of the first embodiment of the circularly polarized antenna according to the invention.

Figure 3:
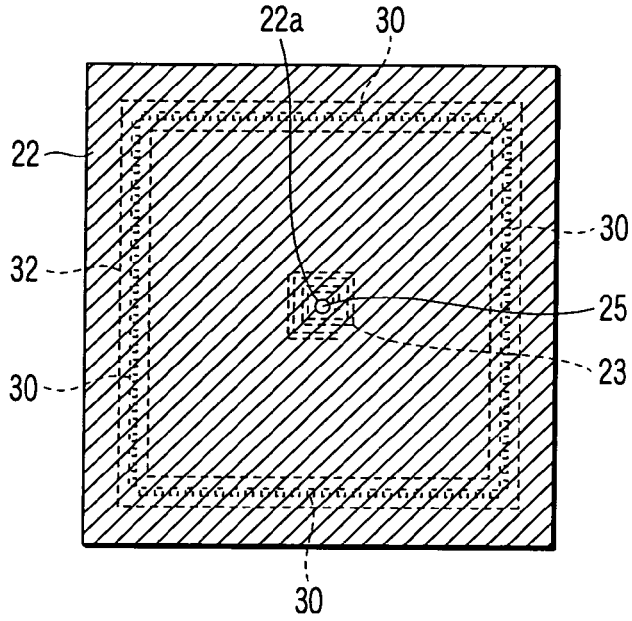
FIG. 3 is a rear view for explaining the configuration of the first embodiment of the circularly polarized antenna according to the invention.

FIG. 3 is a rear view for explaining the configuration of the first embodiment of the circularly polarized antenna according to the invention.

Figure 4A:
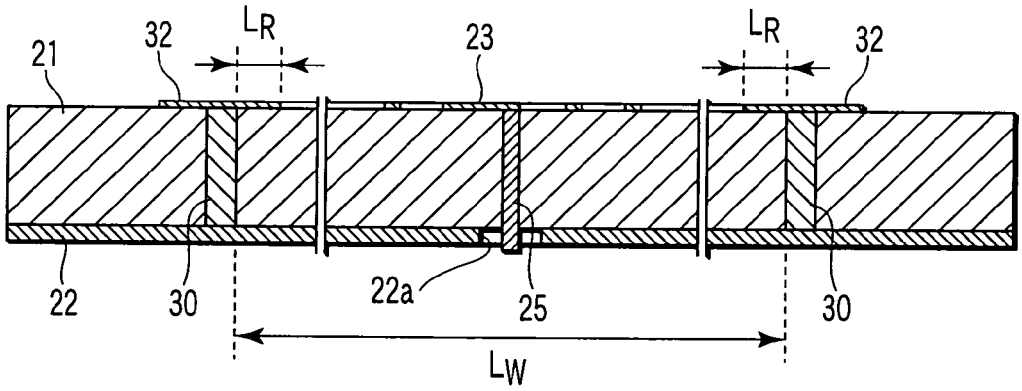
FIG. 4A is an enlarged cross-sectional view taken along line 4A-4A of FIG. 2.

FIG. 4A is an enlarged cross-sectional view taken along line 4A-4A of FIG. 2.

Figure 4B:
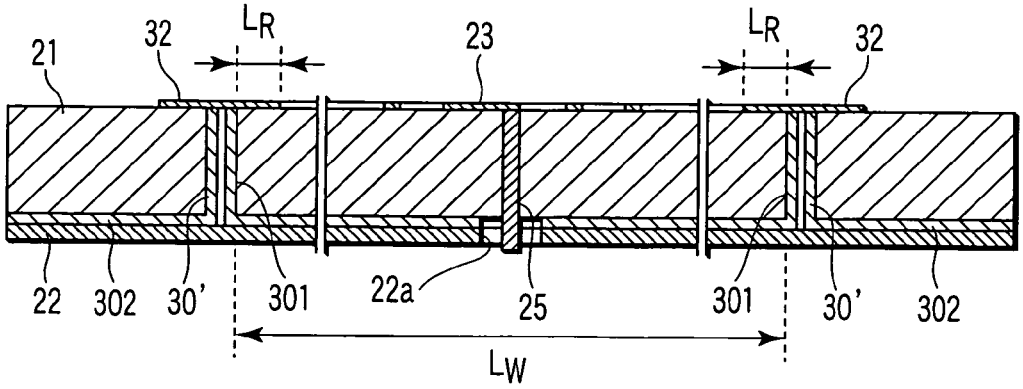
FIG. 4B is an enlarged cross-sectional view taken along line 4B-4B of FIG. 2 in a modified example.

FIG. 4B is an enlarged cross-sectional view taken along line 4B-4B of FIG. 2.

Figure 5:
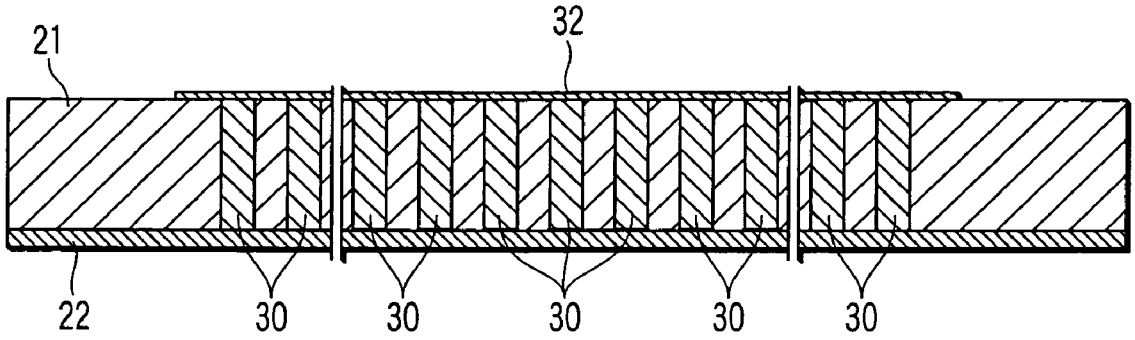
FIG. 5 is an enlarged cross-sectional view taken along line 5-5 of FIG. 2.

FIG. 5 is an enlarged cross-sectional view taken along line 5-5 of FIG. 2.

The circularly polarized antenna according to the present invention basically has, as shown in FIGS. 1 to 5, a dielectric substrate 21; a ground conductor 22 which is piled up one surface side of the dielectric substrate 21; a circularly polarized type of antenna element 23 formed on the opposite surface of the dielectric substrate 21; a plurality of metal posts 30 whose respective one end sides are connected to the ground conductor 22 and penetrate the dielectric substrate 21 along the thickness direction, and whose respective other sides extend up to the opposite surface of the dielectric substrate 21, the plurality of metal posts 30 configuring a cavity by being provided at predetermined intervals so as to surround the antenna element 23; and a conducting rim 32 which short-circuits the respective other end sides of the plurality of metal posts 30 along the array direction thereof, and is provided so as to extend by a predetermined distance in a direction of the antenna element 23 at the side of the opposite surface of the dielectric substrate 21.

Specifically, the circularly polarized antenna 20 is a substrate made of a material having a low dielectric constant (about 3.5). For example, the circularly polarized antenna 20 has a dielectric substrate 21 with a thickness of 1.2 mm; a ground conductor 22 provided on one surface side (the rear face side in FIGS. 1 and 2) of the dielectric substrate 21; a right-handed rectangular spiral unbalanced antenna element 23 formed by, for example, a pattern printing technology on the opposite surface side (the front face side in FIGS. 1 and 2) of the dielectric substrate 21; and a feed pin 25 whose one end is connected to a side end portion (feeding point) at the spiral center side of the antenna element 23, and which penetrates the dielectric substrate 21 in a direction of thickness thereof to pass through a hole 22*a* of the ground conductor 22.

As the above-described dielectric substrate 21, a material such as a quasi-millimeter waveband and low-loss RO4003 (Rogers Corporation) can be used.

As a material of the dielectric substrate 21, a low-loss material having a dielectric constant of about 2 to 5 is available, and examples thereof include glass-cloth Teflon substrates and various thermosetting resin substrates.

The circularly polarized antenna according to the structure described above is substantially equivalent to the circularly polarized antenna in the aforementioned Non-Pat. Document 3. Power is fed from the other end side of the feed pin 25 by means of an unbalanced feeder line, for example, a coaxial cable, a coplanar waveguide using the ground conductor 22 as an earth line, or a microstrip line to be described later, so that it is possible to radiate a radio wave of right hand circular polarization (RHCP) from the antenna element 23.

However, in the circularly polarized antenna according to only this structure, a surface wave along the surface of the dielectric substrate 21 is excited as described above. Consequently, a desired characteristic cannot be obtained as a circularly polarized antenna under the influence of the surface wave.

Thus, in the circularly polarized antenna 20 in this embodiment, in addition to the above-described structure, a cavity structure is employed which is formed such that, for example, columnar metal posts 30 whose one end sides are connected to the ground conductor 22, and whose other end sides penetrate the dielectric substrate 21 to extend up to the opposite surface of the dielectric substrate 21 as shown in FIGS. 4A and 5 are provided at predetermined intervals so as to surround the antenna element 23.

Moreover, in the circularly polarized antenna 20 in this embodiment, in addition to the above-described cavity structure, a conducting rim 32 which sequentially short-circuits the other end sides of the respective metal posts 30 along the array direction, and which extends by a predetermined distance in a direction of the antenna element 23 from the connecting positions with the respective metal posts 30 is provided at the side of the opposite surface of the dielectric substrate 21.

Thus, in the circularly polarized antenna 20 in this embodiment, it is possible to suppress a surface wave by a synergistic effect of the cavity structure and the conducting rim 32.

Note that the plurality of metal posts 30 can be realized as a plurality of hollow metal posts 30' such that a plurality of holes 301 penetrating the dielectric substrate 21 are formed, and plating (through-hole plating) is applied onto the inner walls of the plurality of holes 301.

In this case, the bottom end portions of the plurality of hollow metal posts 30' by through-hole plating are to be connected to the ground conductor 22 via a land 302 formed on one end side of the dielectric substrate 21 by a pattern printing technology.

Hereinafter, to explain an effect due to surface wave suppression by the cavity structure and the conducting rim 32 described above, structural parameters of the respective portions and results of simulation of a characteristic of the circularly polarized antenna 20 obtained by changing the structural parameters will be described.

First, factors as the structural parameters of the respective portions will be described.

A usable frequency of the circularly polarized antenna 20 is 26 GHz, which is within the UWB. A square-shaped spiral of the antenna element 23 has a basic length of a0, and is configured such that lines having lengths of the a0 and of arbitrary multiples are arranged at each angle of 90°.

Figure 6A:
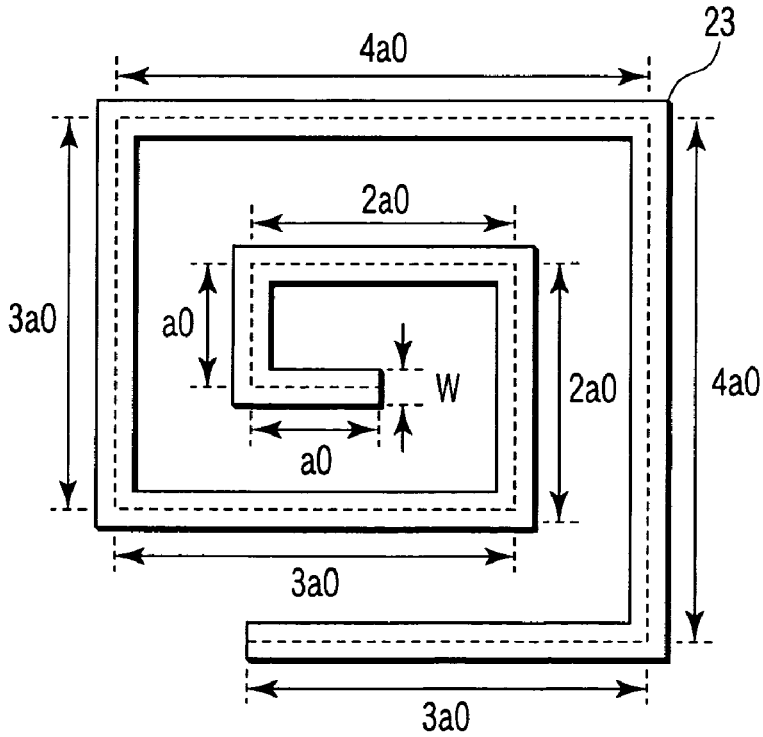
FIG. 6A is an enlarged front view for explaining a configuration of a main part of the first embodiment of the circularly polarized antenna according to the invention.

A typical example of such a square-shaped spiral is shown in FIG. 6A. Namely, in this example, an element width W is made to be 0.25 mm and a basic length a0 is made to be 0.45 mm, and hereinafter, the line lengths are made to be 2a0, 2a0, 3a0, 3a0, 4a0, and 4a0 at each angle of 90°, and the final line length is made to be 3a0, which makes a square-shaped spiral of nine-turn spiral in all.

Figure 6B:
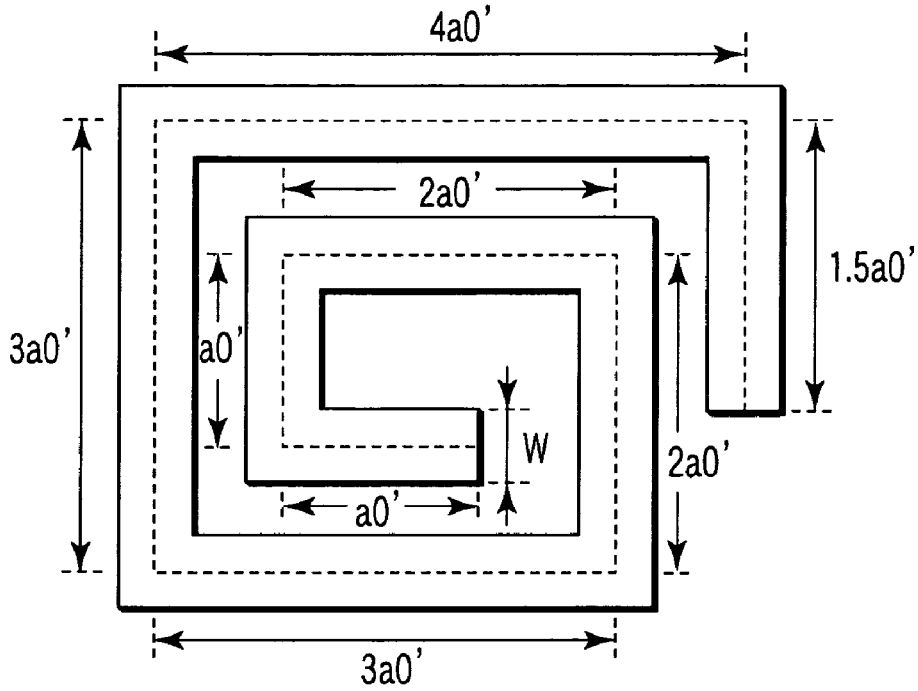
FIG. 6B is an enlarged front view for explaining a configuration of a main part in a modified example of the first embodiment of the circularly polarized antenna according to the invention.

Further, in the case of the square-shaped spiral shown in FIG. 6B, a basic length a0' is made longer than the basic length a0 in FIG. 6A, and the number of turns is reduced.

In this example, an element width W is made to be 0.25 mm and a basic length a0' is made to be 0.7 mm, and hereinafter, line lengths are made to be 2a0', 2a0', 3a0', 3a0', and 4a0' at each angle of 90°, and the final line length is made to be about 1.5a0', which makes a square-shaped spiral of eight-turn spiral in all.

In this case, the final line length is selected to be about 1.5a0' so as to optimize an axial ratio and a reflection characteristic of circular polarization.

Note that, in the following description and embodiment, an example of a square-shaped spiral is shown as the antenna element 23 to be used for the circularly polarized antenna 20.

Figure 7:
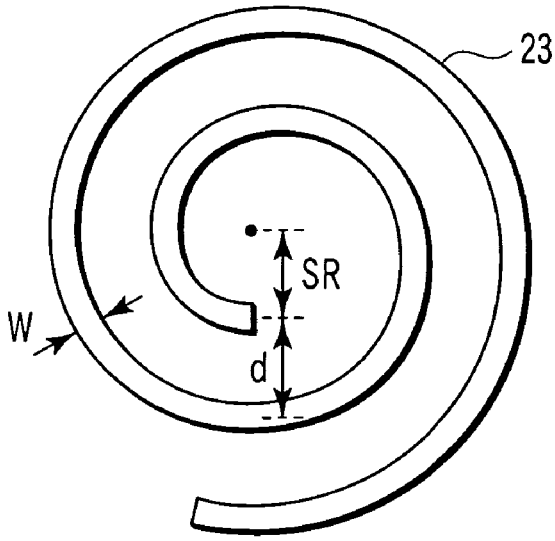
FIG. 7 is an enlarged front view for explaining a configuration of a main part in a modified example of the first embodiment of the circularly polarized antenna according to the invention.

However, as shown in FIG. 7, the circular spiral antenna element 23 can be used as the antenna element 23 to be used for the circularly polarized antenna 20 in place of a square-shaped spiral.

The circular spiral antenna element 23 shown in FIG. 7 is a case of the antenna element 23 formed from a circular spiral in which, for example, a radius initial value SR from a point of reference=0.2 mm, an element width W=0.35 mm, a spiral interval d=0.2 mm, and the number of turns is 2.125. Even when the antenna element 23 formed from such a circular spiral is used as the circularly polarized antenna 20, substantially the same result as that in the case of using the square-shaped spiral antenna element 23 described above is obtained.

Further, an outward form of the dielectric substrate 21 is a square centering around the spiral center of the antenna element 23. As shown in FIG. 2, a length of one side thereof is defined as L (hereinafter referred to as an outward form length), and an outward form of the cavity is also made to be a square concentric therewith.

As shown in FIGS. 4A and 4B, it is assumed that an inside dimension of the cavity is Lw, and moreover, a distance lengthening inward from the inner wall of the cavity of the conducting rim 32 (hereinafter referred to as a rim width) is $L_R$.

Further, diameters of the plurality of metal posts 30 forming the cavity are respectively 0.3 mm, and intervals among the respective metal posts 30 are 0.9 mm.

Figure 8:
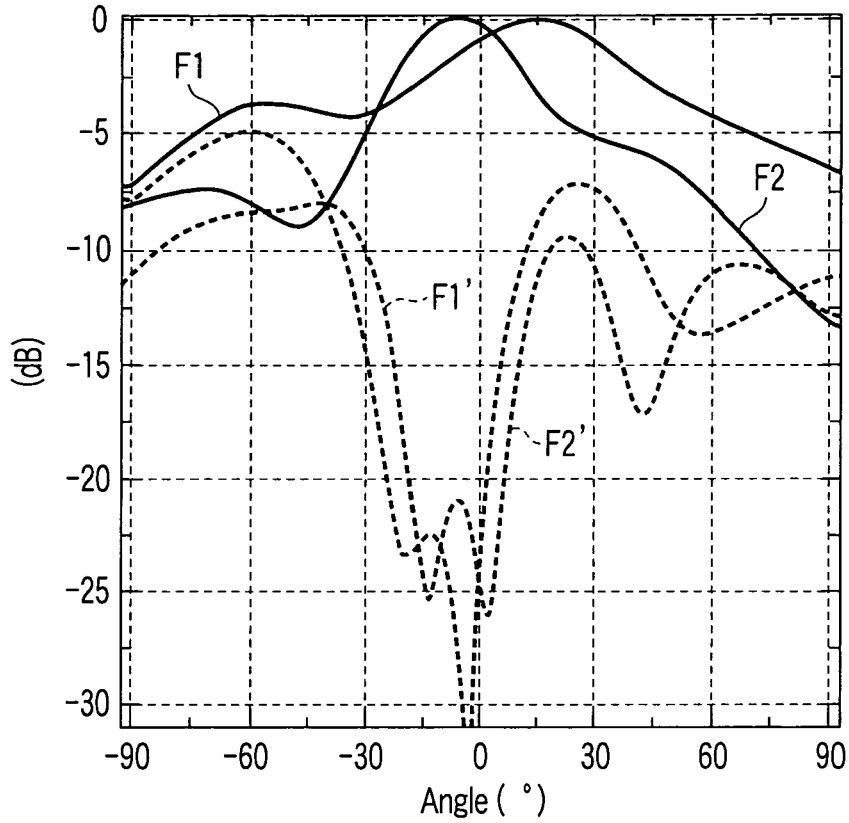
FIG. 8 is a characteristic graph when the configuration of the main part of the first embodiment of the circularly polarized antenna according to the present is removed.

FIG. 8 shows results of simulations of a radiation characteristic of a vertical surface (the yz surface in FIGS. 1 and 2) in the case where a cavity formed by the plurality of metal posts 30 and the conducting rim 32 are not provided.

In FIG. 8, F1 and F1' are characteristics of main polarization (left hand circular polarization: LHCP) and cross polarization (right hand circular polarization: RHCP) in the case of an outward form length=18 mm, and F2 and F2' are characteristics of main polarization and cross polarization in the case of an outward form length=24 mm.

Here, a radiation characteristic required as a circularly polarized antenna is a single-peaked characteristic which is symmetric and broad, centering on a direction of 0° with respect to main polarization, and is required to be a radiant intensity sufficiently lower than that of main polarization within a broad angle range with respect to cross polarization (which is zero in the case of a complete circular polarization).

In contrast thereto, the characteristics F1 and F2 of main polarizations in FIG. 8 are dissymmetric and there are large disturbances in gains. It can be understood that the cross polarizations are at radiation levels which are equivalent to or close to those of the main polarizations in the vicinity of −60° and −40°.

Such disturbances in radiant characteristics are brought about under the influence of the surface wave described above.

The inventors of the present application have assumed at first that it is possible to suppress the influence of a surface wave by using a cavity structure by the plurality of metal posts 30 described above, and have obtained results of simulations with respect to the similar several radiant characteristics as those described above, the simulations being carried out with a size of the cavity by the plurality of metal posts 30 being variously changed.

However, it has been proved that disturbances in radiant characteristics due to the influence of a surface wave cannot be suppressed by merely using the cavity structure.

Consequently, it has been found that it is possible to remove disturbances in radiation characteristics due to the influence of a surface wave by providing the conducting rim 32 described above in the cavity structure.

Figure 9:
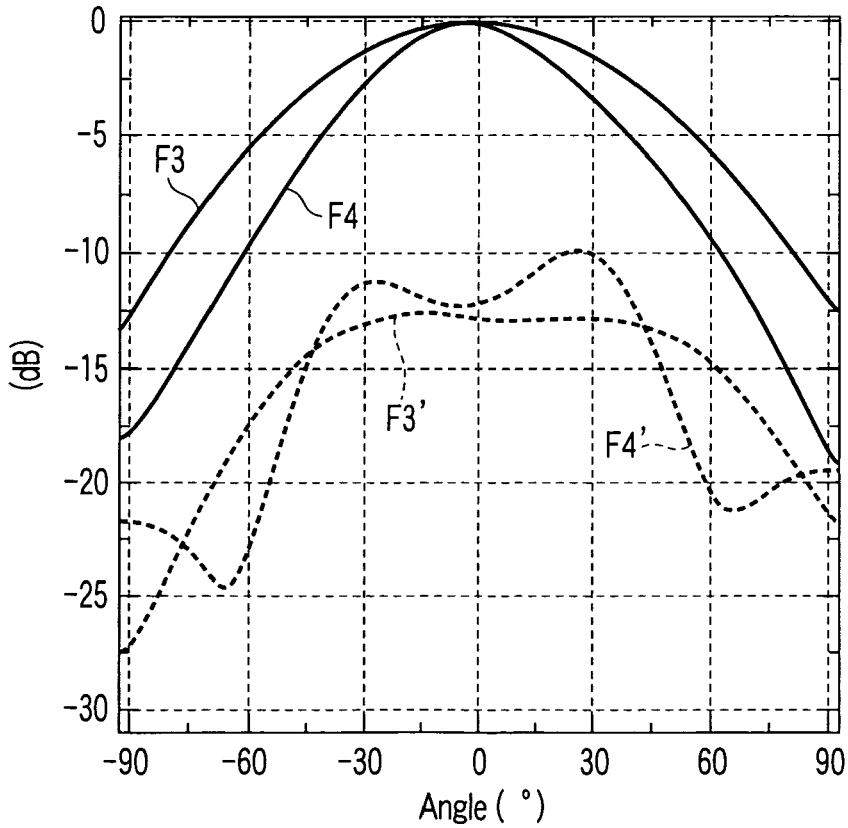
FIG. 9 is a characteristic graph when removing the configuration of the main part of the first embodiment of the circularly polarized antenna according to the invention.

FIG. 9 shows results of simulations with respect to characteristics F3 and F4 of main polarizations and characteristics F3' and F4' of cross polarizations in the case of outward form lengths L=18 mm and L=24 mm, when a cavity whose inside dimension Lw=9 mm is provided by the plurality of metal posts 30 and the conducting rim 32 whose rim width $L_R$=1.2 mm is provided.

As is clear from FIG. 9, the characteristics F3 and F4 of the main polarizations are made single-peaked characteristics which are symmetric and broad centering on a direction of 0°. Thus, it can be understood that, with respect to the characteristics F3' and F4' of the cross polarizations as well, there are slow changes in radiant intensities which are sufficiently lower than the main polarizations F3 and F4 within a broad angle range, and desired characteristics required as the circularly polarized antenna described above are obtained.

As a result of the simulations with respect to various radiation characteristics in the same manner as described above, the simulations being carried out with the structural parameters of the respective portions being changed, it has been proved that radiation characteristics when there is no conducting rim 32 show the dependency onto an outward form length L and a cavity inside dimension Lw of the dielectric substrate 21. It has been also proved that, to show a summarized trend, when an outward form length L is large (L=24, 18 mm), main polarization characteristic is made closer from a triple-peaked form to a single-peaked form as a cavity inside dimension Lw is made larger from 3 to 10 mm.

Further, it has been proved that, when an outward form length L of the dielectric substrate 21 is relatively small (L=12 mm), the main polarization characteristic is made closer from a double-peaked form to a single-peaked form as a cavity inside dimension Lw is made larger from 3 to 10 mm.

However, it has been proved that, in both cases, disturbances in the cross polarizations are large and a difference with main polarization component is made smaller within a usable angle range, and the polarization selectivity is low, which is insufficient as regards desired characteristics as described in FIG. 9.

Note that 1.2 mm, which is the rim width $L_R$, corresponds to approximately ¼ of a wavelength of a surface wave.

Namely, the portion with the rim width $L_R$=1.2 mm forms a transmission channel with a length of λg/4 (λg is a wavelength in waveguide) by which an impedance reaches an infinite value with respect to a surface wave as the post wall side is seen from the tip side.

Accordingly, electric current along the surface of the dielectric substrate 21 does not flow, and excitation of a surface wave is suppressed by this electric current inhibition, which prevents disturbances in radiation characteristics.

Therefore, when the circularly polarized antenna 20 is applied to a frequency band other than that described above, it suffices to set the rim width $L_R$ in accordance with the frequency.

Second Embodiment

In the circularly polarized antenna 20 of the above-described first embodiment, it suffices to set the above circularly polarized antenna 20 in an array when the gain required as a UWB radar or the like is insufficient, or when it is necessary to narrow a beam down.

Further, when the circularly polarized antenna is set in an array, a sequential rotation array shown in the following Non-Pat. Document 5 can be employed in which a wideband circular polarization characteristic and a wideband reflection characteristic are realized as an antenna overall by suppressing cross-polarization components.

Non-Pat. Document 5: Teshirogi, et al. "Wideband circularly polarized array antenna with sequential rotations and phase shift of elements", Proc. of ISAP' 85, 024-3, pp. 117-120, 1985

A sequential rotation array is an array antenna with a plural number N of antenna elements having identical configuration arranged in identical plane, in which the respective antenna elements are arranged so as to be rotated sequentially by p·π/N radian around an axis in a radiation direction, and feeding phases to the respective antenna elements are deviated by p·π/N radian in accordance with an array angle.

Here, p is an integer number of 1 or more and N−1 or less.

With such a structure, cross-polarization components are balanced out in the entire circularly polarized antenna and substantially complete circular polarization characteristics can be obtained even when the polarization characteristics of the respective antenna elements are incomplete circular polarizations (i.e., elliptic polarization).

Hereinafter, a principle of a sequential rotation array will be described with the most simple example in the case of P=1 and N=2.

Figure 10:
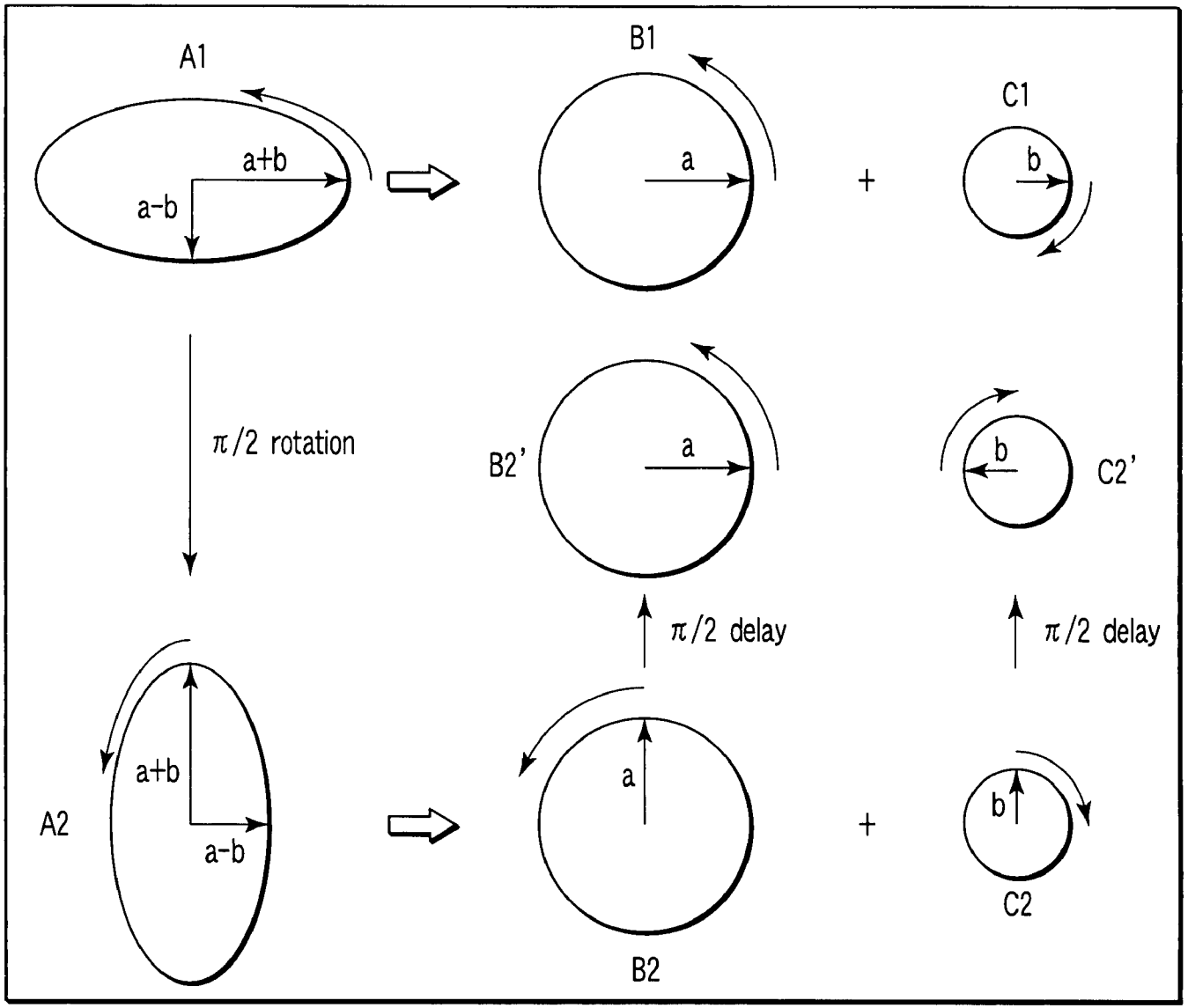
FIG. 10 is a diagram for explaining a principle of a sequential rotation array to which second to sixth embodiments of the circularly polarized antenna according to the present invention are applied.

As shown in FIG. 10, an elliptic polarization characteristic A1 of an antenna element having an elliptic polarization characteristic with a transverse axis intensity of a+b and a longitudinal axis intensity of a−b can be regarded as one in which a left-hand main polarization component B1 (circular polarization) with an intensity "a" and a right-hand cross polarization component C1 (circular polarization) with an intensity b are synthesized.

Thus, when this antenna element is arranged so as to be rotated by π/2, a vertically long elliptic polarization characteristic A2 with a longitudinal axis intensity of a+b and a transverse axis intensity of a−b is obtained. This vertically long elliptic polarization characteristic A2 can be regarded to be obtained by synthesizing a left-hand main polarization component B2 (circular polarization) with an intensity a and a right-hand cross polarization component C2 (circular polarization) with an intensity b.

However, when an in-phase feed is carried out to the antenna element with the elliptic polarization characteristic A1 and the antenna element with the elliptic polarization characteristic A2, the directions of polarization of both of them are shifted by π/2 in both of the main polarizations and the cross polarizations.

Thus, when a phase of feeding to the antenna element with the elliptic polarization characteristic A2 is delayed by π/2 from a phase of feeding to the antenna element with the elliptic polarization characteristic A1, a main polarization component B2' of the antenna element with the elliptic polarization characteristic A2 is made to be in-phase with a main polarization component B1 of the antenna element with the elliptic polarization characteristic A1, and the both (B2', B1) are synthesized to be emphasized.

In contrast thereto, a cross polarization component C2' of the antenna element with the elliptic polarization characteristic A2 is in anti-phase with a cross polarization component C1 of the antenna element with the elliptic polarization characteristic A1, and the intensities are equal, which are balanced out.

Accordingly, the polarization characteristic of the entire antenna becomes a substantially complete circular polarization, in which the left-hand main polarization components B1 and B2' are synthesized.

Figure 11:
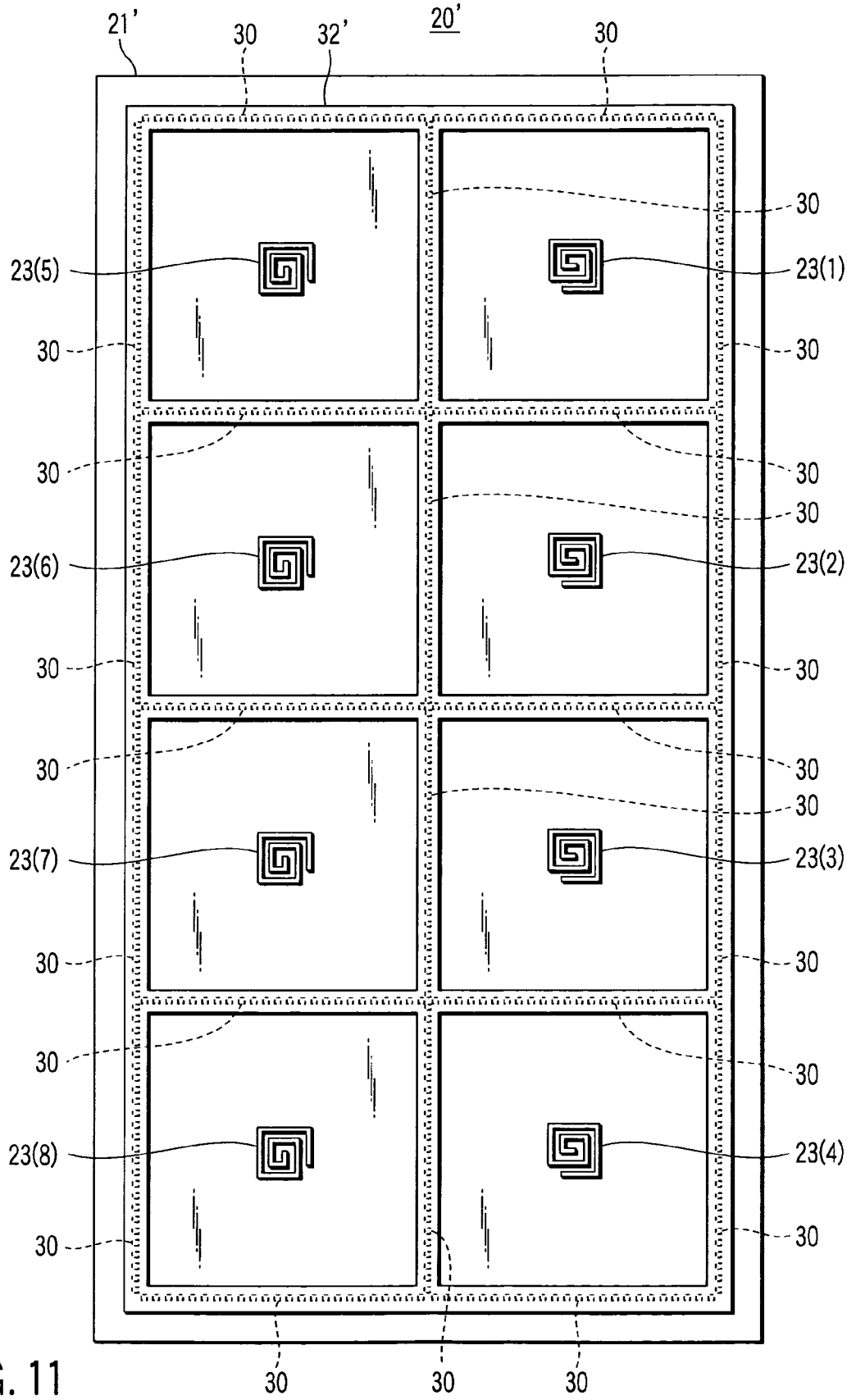
FIG. 11 is a front view for explaining a configuration of a sequential rotation array to which the second embodiment of the circularly polarized antenna according to the invention is applied.
Figure 12:
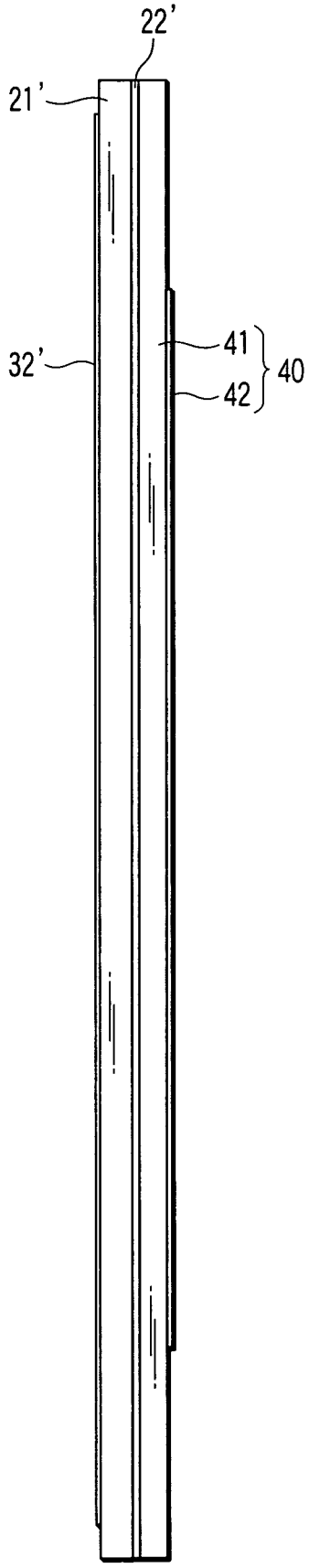
FIG. 12 is a side view for explaining the configuration of the sequential rotation array to which the second embodiment of the circularly polarized antenna according to the invention is applied.
Figure 13:
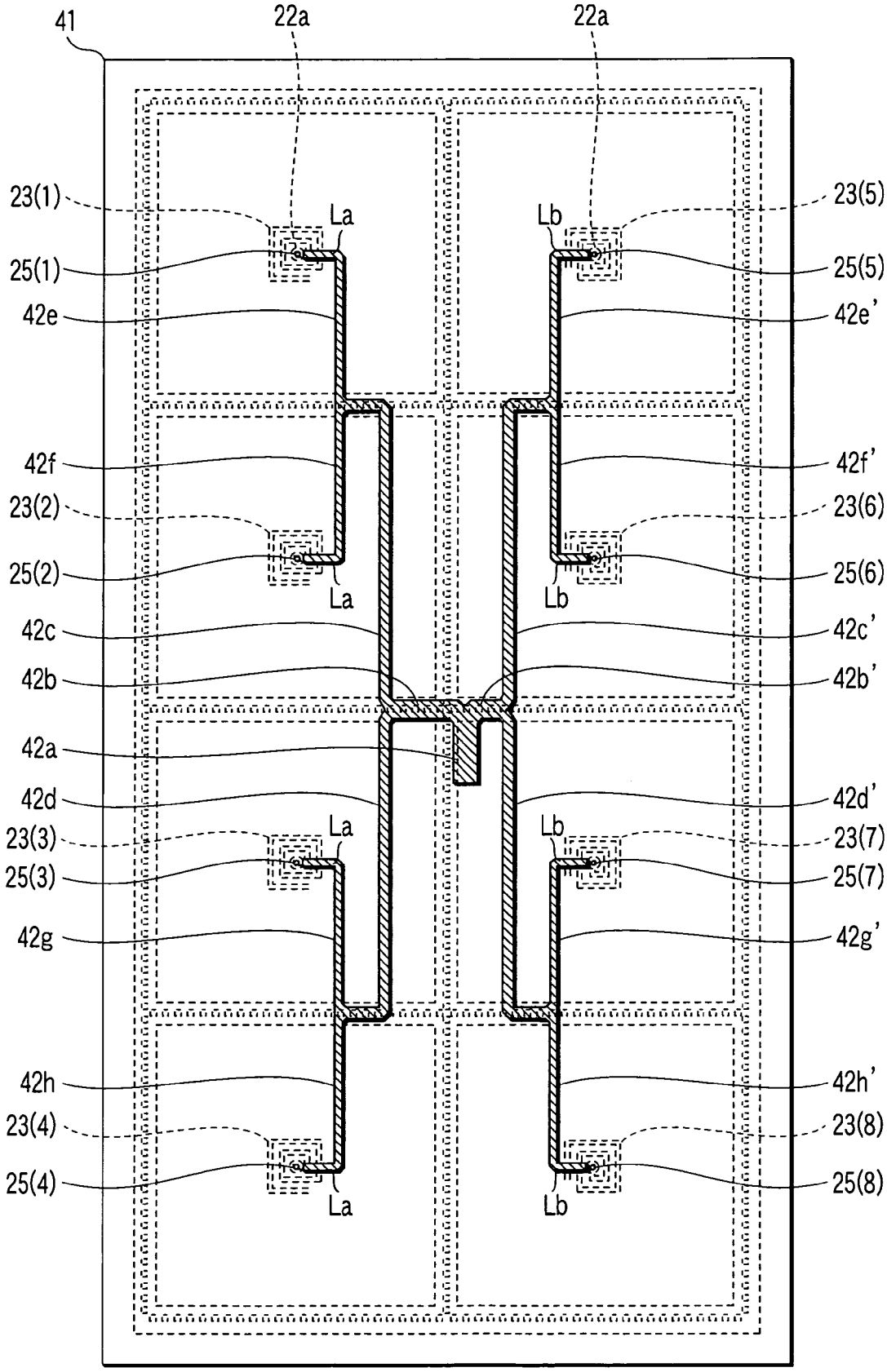
FIG. 13 is a rear view for explaining the configuration of the sequential rotation array to which the second embodiment of the circularly polarized antenna according to the invention is applied.

FIGS. 11 to 13 show a configuration of a circularly polarized antenna 20' which is set in an array by using the above-described principle of a sequential rotation array as a second embodiment of the circularly polarized antenna according to the present invention.

Namely, FIG. 11 is a front view for explaining a configuration of a sequential rotation array to which the second embodiment of the circularly polarized antenna according to the invention is applied.

FIG. 12 is a side view for explaining the configuration of the sequential rotation array to which the second embodiment of the circularly polarized antenna according to the invention is applied.

FIG. 13 is a rear view for explaining the configuration of the sequential rotation array to which the second embodiment of the circularly polarized antenna according to the invention is applied.

The circularly polarized antenna 20' according to the second embodiment is configured such that the antenna elements 23 of the first embodiment are set in an array in two lines at four stages on a vertically long rectangular like shaped common dielectric substrate 21' and ground conductor 22'.

Further, a feed unit 40 for distributing and feeding excitation signals to a plurality of antenna elements is formed at a side of the ground conductor 22' of the circularly polarized antenna 20'.

Eight antenna elements 23(1) to 23(8) formed to be right-hand rectangular spirals in the same manner as in the first embodiment are provided in two lines at four stages on the surface of the dielectric substrate 21'.

Here, axial rotation angles along a radiation direction of the four antenna elements 23(1) to 23(4) in the right line are identical, and angles around axes along a radiation direction of the four antenna elements 23(5) to 23(8) in the left line are also identical.

Here, the four antenna elements 23(5) to 23(8) in the left line are rotated by $\pi/2$ in a counterclockwise direction with respect to the antenna elements 23(1) to 23(4) in the right line.

Further, the respective antenna elements 23(1) to 23(8) are, in the same manner as in the first embodiment, surrounded with cavities formed by arraying the plurality of metal posts 30 whose one end sides are connected to the ground conductor 22'.

Moreover, the respective antenna elements 23(1) to 23(8) couple the other end sides of the respective metal posts 30 together along the array direction thereof by means of the conducting rim 32' which extends by a predetermined distance (an amount of the rim width $L_R$ described above) in directions of the respective antenna elements 23 from the connecting positions with the respective metal posts 30.

Namely, the respective antenna elements 23(1) to 23(8) are configured so as to prevent a surface wave from being generated for each antenna element.

Note that, when the plurality of antenna elements 23(1) to 23(8) are arranged in a matrix in a plane as the circularly polarized antenna 20', the cavities and the conducting rims 32' among adjacent antenna elements are made to be shared, and they can be formed in a lattice shape as a whole.

However, the conducting rim 32' provided between adjacent two antenna elements are formed so as to extend by a predetermined distance (the rim width $L_R$ described above) to the both antenna elements.

The respective feed pins 25(1) to 25(8) whose one end sides are connected to the feeding points of the respective antenna elements 23(1) to 23(8) penetrate the dielectric substrate 21', and pass through the holes **22*a* of the ground conductor 22' without contacting to them, and further penetrate a feeding dielectric substrate 41 configuring the feed unit 40** to project the other end sides thereof on the surface.

Then, microstrip type feed lines **42(*a*) to 42(*h*) and 42(*b*') to 42(*h*') with the ground conductor 22' being as an earth are formed on the surface of the feeding dielectric substrate 41 as shown in FIG. 13**.

The feed lines **42(*a*) to 42(*h*) and 42(*b*') to 42(*h*') have: two feed lines 42*b* and 42*b*' which are divaricated into right and left from the input/output feed line 42*a* connected to a transmitting unit or receiving unit (not shown); two feed lines 42*c* and 42*d* which are divaricated into above and below from the line 42*b* lengthening toward the left therebetween; and four feed lines 42*e* to 42*h* which are respectively divaricated into from the two lines 42*c* and 42*d***.

Then, the four feed lines **42*e* to 42*h* are connected to the respective feed pins 25(1) to 25(4) of the antenna elements 23(1) to 23(4) in the right line in FIG. 11**.

The line **42*b*' divaricated toward the right from the input/output feed line 42*a* also has, in substantially the same manner as that on the left side, two feed lines 42*c*' and 42*d*' which are divaricated into above and below, and four feed lines 42*e*' to 42*h*' which are respectively divaricated into from the two lines 42*c*' and 42*d*'**.

The four feed lines **42*e*' to 42*h*' are connected to the respective feed pins 25(5) to 25(8) of the antenna elements 23(5) to 23(8) in the left line in FIG. 11**.

Here, line lengths La to the respective feed pins 25(1) to 25(4) are set to be equal as seen from the input/output feed line **42*a*, and line lengths Lb to the respective feed pins 25(5) to 25(8) are also set to be equal as seen from the input/output feed line 42*a***.

However, in order to configure the sequential rotation array described above, the line lengths Lb are set to be shorter than the line lengths La by a length corresponding to ¼ of a propagating (waveguide) wavelength $\lambda g$ of a signal of a usable frequency (for example, 26 GHz).

Note that, in FIG. 13, a difference between line lengths La and Lb is provided to lengths of the lines **42*b* and 42*b*'**. However, the aforementioned difference may be provided to other lines.

In the circularly polarized antenna 20' according to the second embodiment configured in this way, a polarization characteristic of each antenna element 23 has single-peaked directivity similar to the first embodiment by preventing a surface wave from being generated by the cavities due to the plurality of metal posts 30 and the conducting rim 32'.

Moreover, in the circularly polarized antenna 20' according to the second embodiment, as the entire antenna, cross polarization components of the four antenna elements 23(1) to 23(4) in the right line and cross polarization components of the four antenna elements 23(5) to 23(8) in the left line are balanced out by means of the configuration of a sequential rotation array. Accordingly, main polarization components of the eight antenna elements 23(1) to 23(8) are synthesized together, which brings about high gain with substantially complete circular polarization.

Moreover, in the circularly polarized antenna 20' according to the second embodiment, the antenna elements are provided at four stages in a vertical direction, and therefore, a beam divergence on a vertical surface can be appropriately narrowed. Even when components of an unusable frequency band within the UWB band are included, a radiation in a direction of a high-wave angle which becomes problematic can be suppressed, which can be prevented substantive disturbance to an unusable frequency band.

The feed unit 40 of the circularly polarized antenna 20' set in an array as described above carries out distribution and supply of excitation signals to the respective antenna elements by the microstrip type feed lines 42 formed on the feeding dielectric substrate 41. However, the feed unit can be configured by coplanar waveguides.

In this case, it may be configured by any one of a method in which a coplanar waveguide type of feed lines are formed on the surface of the feeding dielectric substrate 41 in the same manner as described above, and a method in which a coplanar waveguide type of feed lines are directly formed on the ground conductor 22'.

In particular, in the latter method, there is an advantage that the feeding dielectric substrate 41 can be omitted.

Further, in the above-described second embodiment, the four antenna elements having identical rotation angle and arrayed in a line are made to be a set, and the four antenna elements having a rotation angle different by $\pi/2$ therefrom are made to be another set, so that the sequential rotation array is configured by a total of two sets of antenna element groups. However, this does not limit the present invention, and the number of antenna elements, the number of sets, and the like may be variously changed.

For example, it can be configured such that array angles of the four antenna elements 23(1) to 23(4) arrayed in a line vertically are sequentially rotated by $\pi/2$, and array angles of the four antenna elements 23(5) to 23(8) arrayed in a line vertically are also sequentially rotated by $\pi/2$, and are made to be different by $\pi/2$ from the adjacent elements.

Hereinafter, several embodiments to which these modified examples are applied will be described.

Third Embodiment

Figure 14:
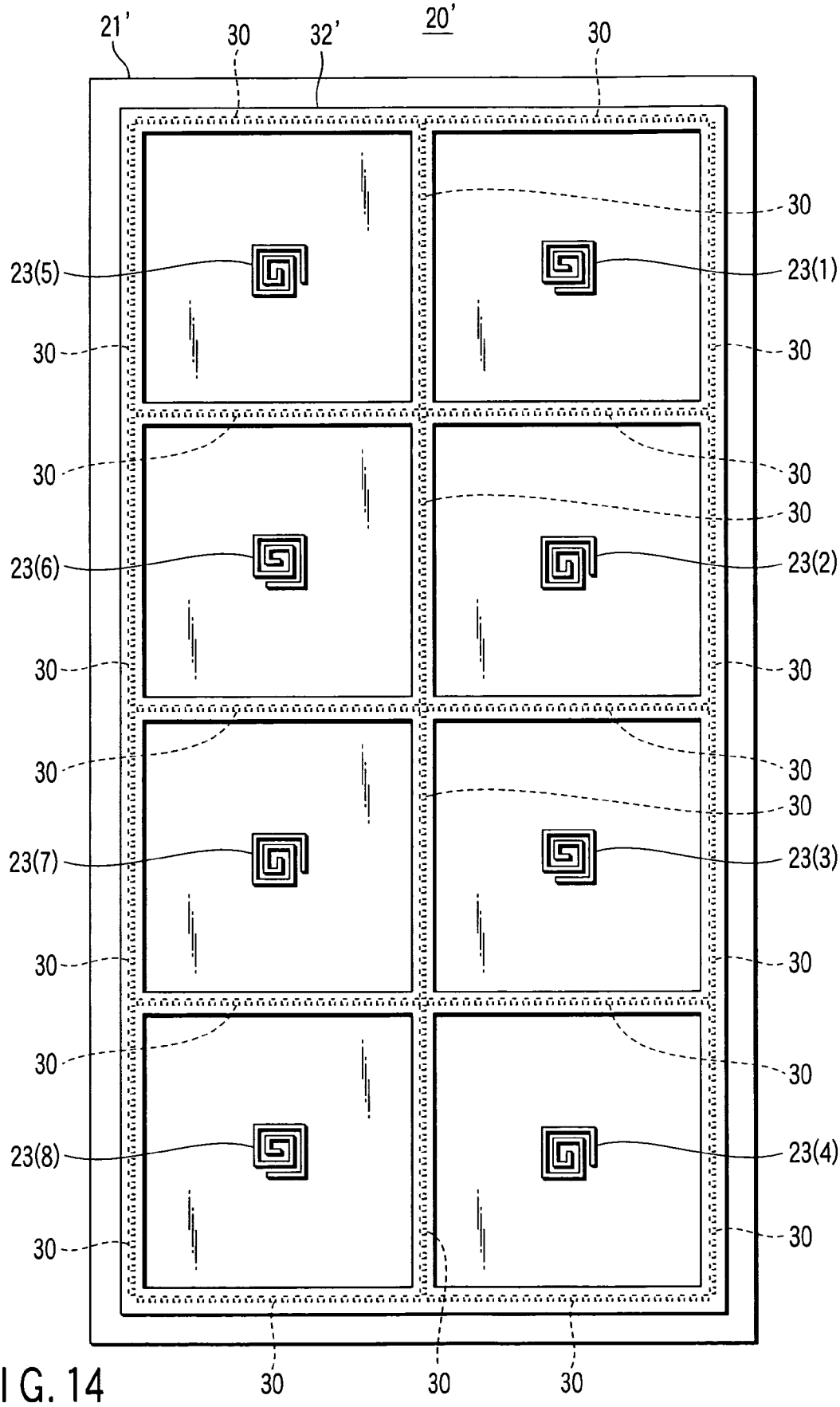
FIG. 14 is a front view for explaining a configuration of a sequential rotation array to which the third embodiment of the circularly polarized antenna according to the invention is applied.

FIG. 14 is a front view for explaining a configuration of a sequential rotation array to which a third embodiment of the circularly polarized antenna according to the present invention is applied.

As shown in FIG. 14, the circularly polarized antenna 20' having the sequential rotation array structure to which the third embodiment of the circularly polarized antenna according to the invention is applied is configured as two sets of two-elemental sequential rotation arrays having identical configuration by the four antenna elements 23(1) to 23(4) and 23(5) to 23(8) respectively arrayed in a line vertically.

Namely, in the circularly polarized antenna 20' shown in FIG. 14, an array angle of the antenna element 23(2) is rotated by $\pi/2$ with respect to the antenna element 23(1), the antenna element 23(3) is made to have identical array angle as the antenna element 23(1), and the antenna element 23(4) is made to have identical array angle as the antenna element 23(2).

Further, the four antenna elements 23(5) to 23(8) arrayed in a line vertically which are adjacent thereto are also configured as two sets of two-elemental sequential rotation arrays, and are arranged so as to be different by $\pi/2$ from the adjacent elements.

Fourth Embodiment

Figure 15:
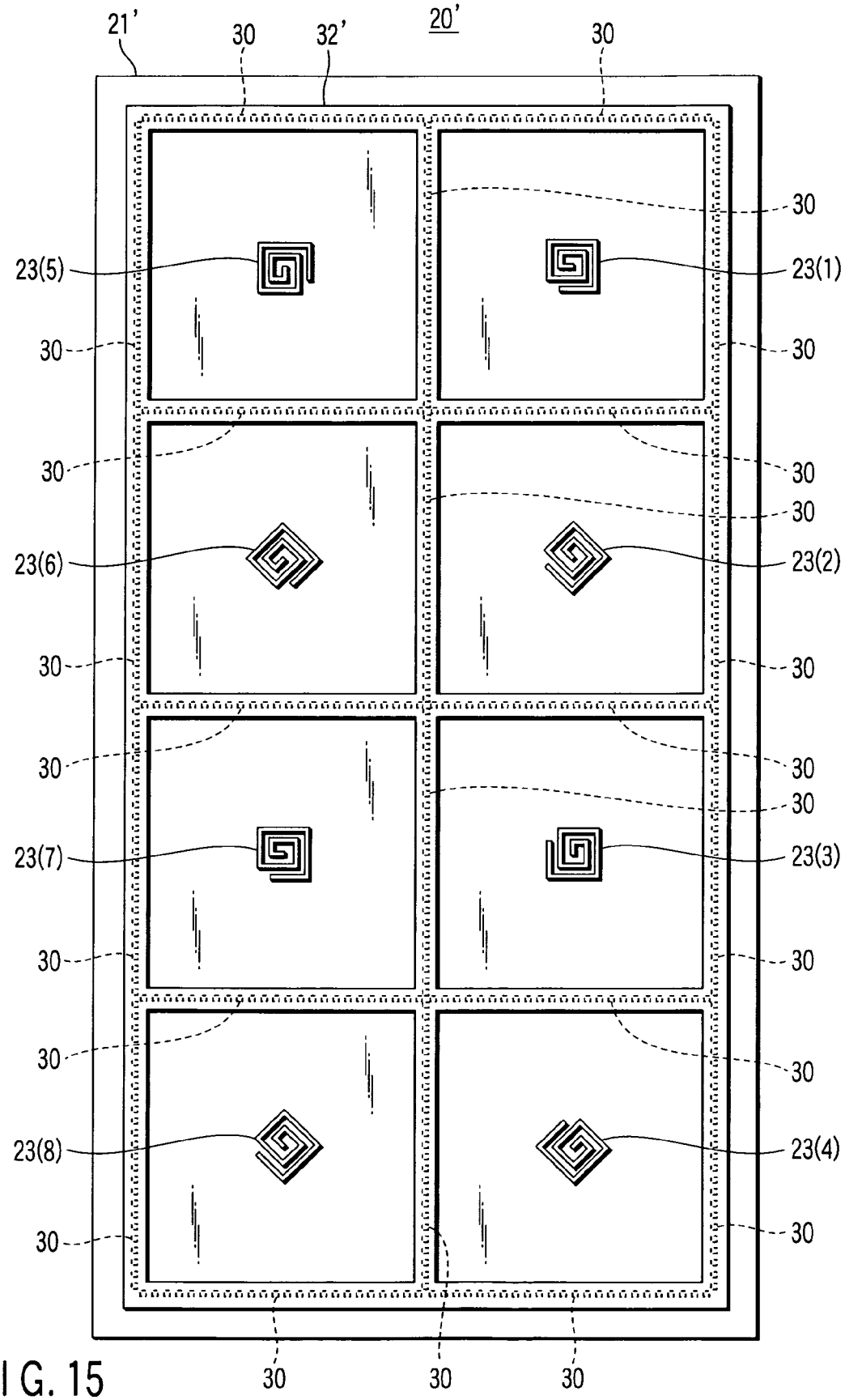
FIG. 15 is a front view for explaining a configuration of a sequential rotation array to which the fourth embodiment of the circularly polarized antenna according to the invention is applied.

FIG. 15 is a front view for explaining a configuration of a sequential rotation array to which a fourth embodiment of the circularly polarized antenna according to the present invention is applied.

As shown in FIG. 15, in the circularly polarized antenna 20' having the sequential rotation array configuration to which the fourth embodiment of the circularly polarized antenna according to the invention is applied, array angles of the four antenna elements 23(1) to 23(4) in the left and right arrayed in a line vertically are arranged so as to be sequentially rotated by $\pi/4$. In addition, array angles of the four antenna elements 23(5) to 23(8) arrayed in a line vertically which are adjacent thereto are also arranged so as to be sequentially rotated by $\pi/4$, and are made to be different by $\pi/2$ from the adjacent elements.

Fifth Embodiment

Figure 16:
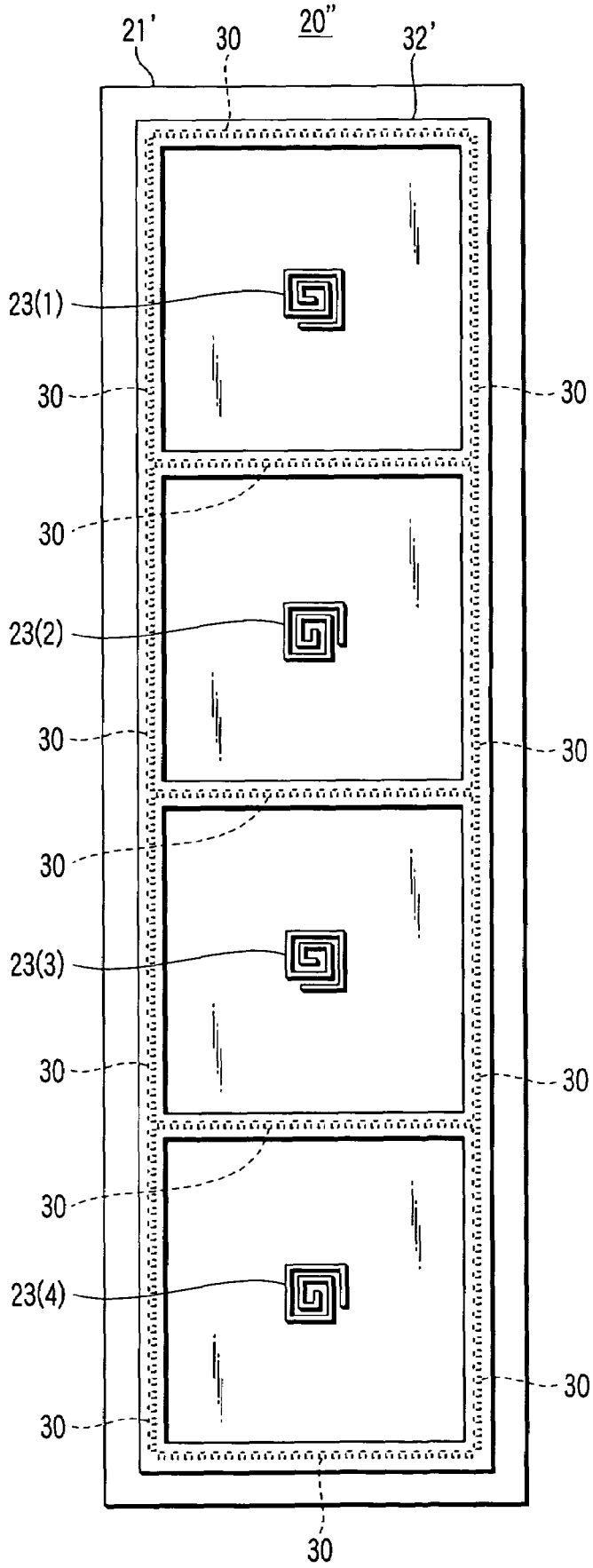
FIG. 16 is a front view for explaining a configuration of a sequential rotation array to which the fifth embodiment of the circularly polarized antenna according to the invention is applied.

FIG. 16 is a front view for explaining a configuration of a sequential rotation array to which a fifth embodiment of the circularly polarized antenna according to the present invention is applied.

As shown in FIG. 16, the circularly polarized antenna 20' having the sequential rotation array configuration to which the fifth embodiment of the circularly polarized antenna according to the invention is applied is configured as two sets of two-elemental sequential rotation arrays having identical configuration by the four antenna elements 23(1) to 23(4) arrayed in a line vertically.

Sixth Embodiment

Figure 17:
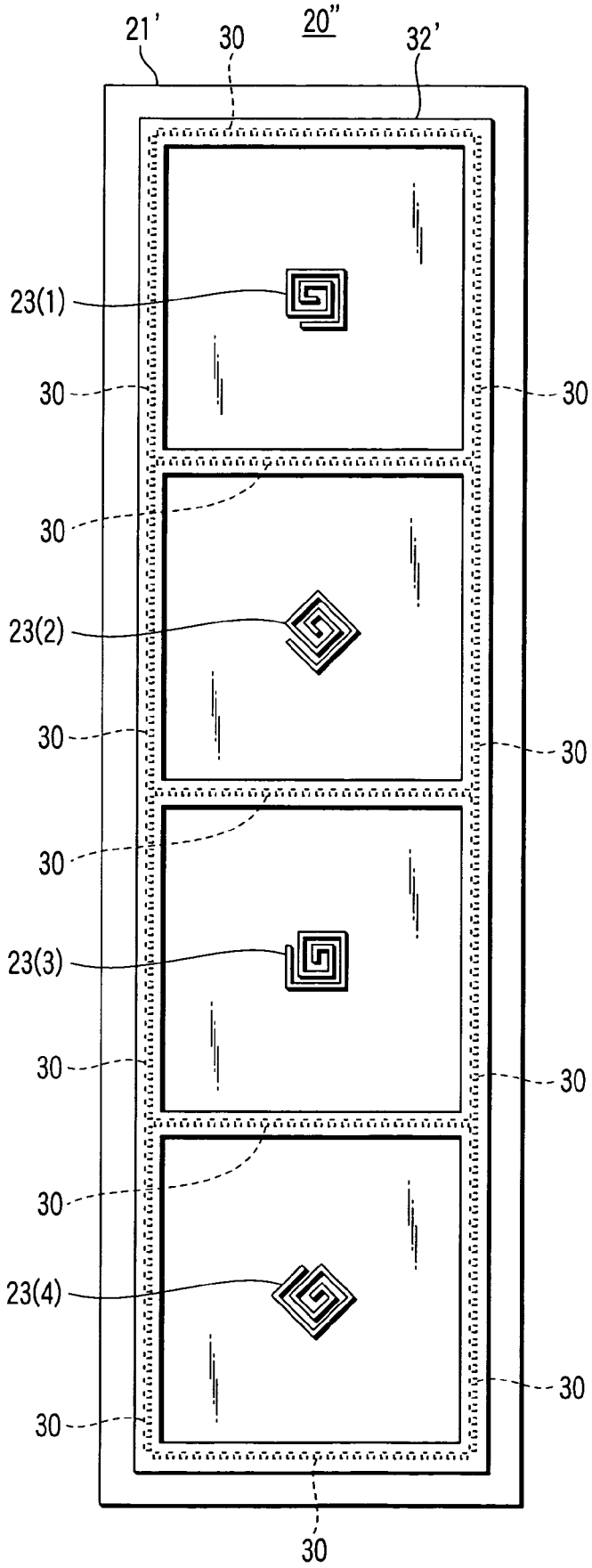
FIG. 17 is a front view for explaining a configuration of a sequential rotation array to which the sixth embodiment of the circularly polarized antenna according to the invention is applied.

FIG. 17 is a front view for explaining a configuration of a sequential rotation array to which a sixth embodiment of the circularly polarized antenna according to the present invention is applied.

As shown in FIG. 17, a circularly polarized antenna 20" having the sequential rotation array configuration to which the sixth embodiment of the circularly polarized antenna according to the invention is applied is configured as two sets of two-elemental sequential rotation arrays having identical configuration in which the four antenna elements 23(1) to 23(4) arrayed in a line vertically are arranged so as to be respectively rotated by $\pi/4$.

Note that, also in the case of any of the circularly polarized antennas shown in FIGS. 14 to 17, an in-phase feed is carried out among the respective antenna elements having identical array angle by a feed unit, and feeding is carried out among the respective antenna elements having different array angles with a phase difference according to an angle difference thereamong based on the concept according to the principle of a sequential rotation array shown in FIG. 10 and a feeding structure of FIG. 13. Consequently, distribution and supply are carried out in such a manner that the respective main polarization components are in-phase, and the respective cross polarization components are out of phase, which balances out the respective cross polarization components, and substantially complete circular polarization characteristic can be obtained.

Further, in the case of any of the circularly polarized antennas shown in FIGS. 14 to 17, it suffices to arrange them in three lines or more in a transverse direction in order to narrow a beam width in a horizontal direction.

Incidentally, it can be thought that, in the circularly polarized antenna of the invention, a resonator is configured by providing the cavity due to the plurality of metal posts 30 and the conducting rim 32 on the dielectric substrate 21, and that the resonator is excited by the circularly polarized antenna elements 23.

Because the resonator is configured in the circularly polarized antenna of the invention, there is a resonant frequency. At the resonant frequency, since an input impedance of the circularly polarized antenna is made extremely large, the antenna stops radiation.

In this case, a resonant frequency of the resonator is determined based on the structural parameters of the resonator and the circular polarized antenna elements.

In this case, a resonant frequency of the resonator is determined based on the structural parameters of the resonator and the circular polarized antenna element.

Accordingly, a frequency characteristic of an antenna gain brings about a rapidly deep notch in the vicinity of the resonator frequency.

Provided that the resonator frequency can be matched to, for example, the RR prohibited band (23.6 to 24.0 GHz) described above, it is possible to remarkably reduce interference with an earth exploration-satellite services or the like by using such an antenna as a transmitting antenna for a UWB radar.

Figure 18A:
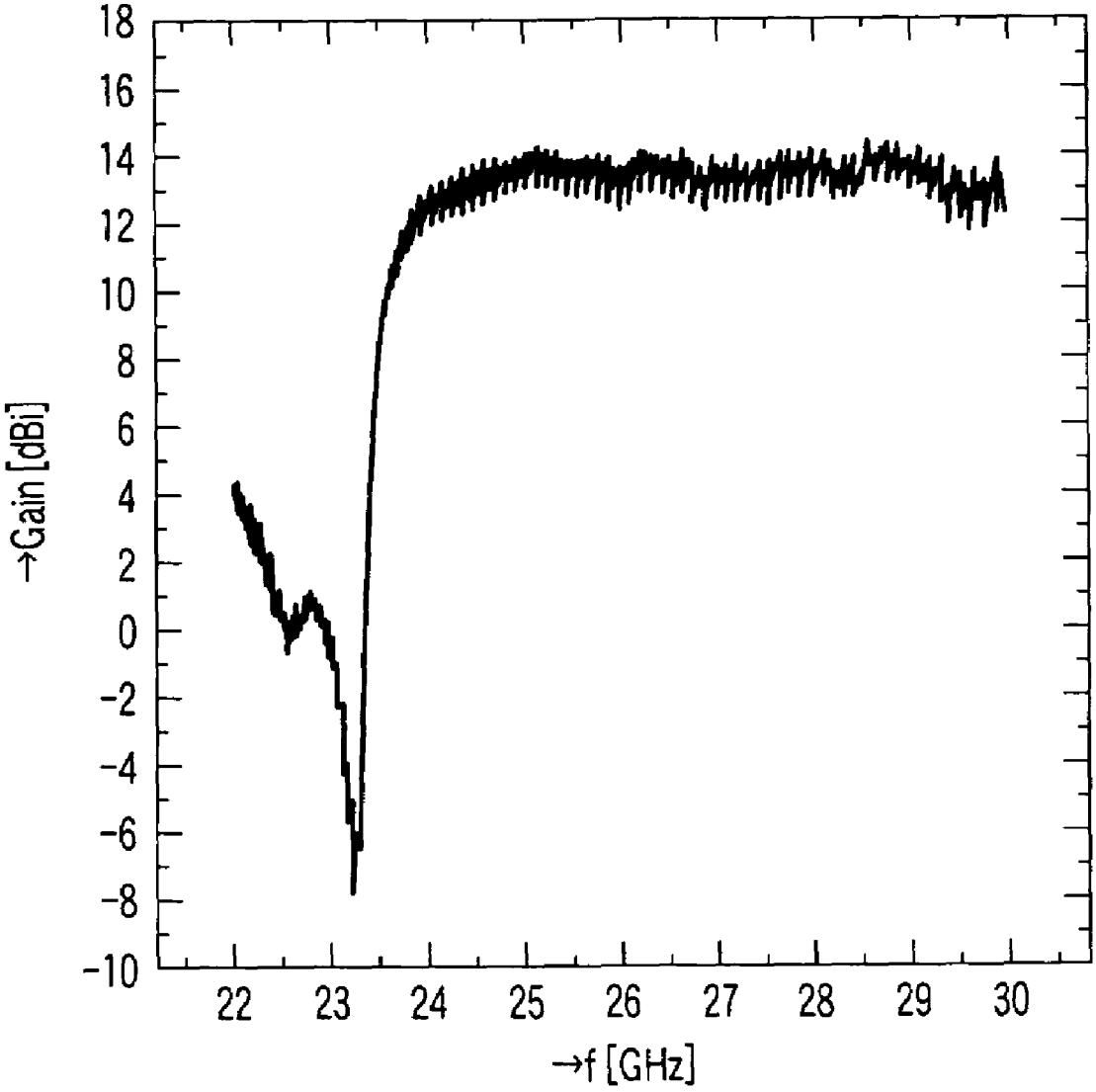
FIG. 18A is a graph for explaining a gain profile of the circularly polarized antenna configured such that a resonant frequency of a resonator is within an RR prohibited band in the configuration of the sequential rotation array to which the third embodiment of the circularly polarized antenna according to the invention is applied.

FIG. 18A is a graph showing results of experimentally manufacturing a circularly polarized antenna configured as shown in FIG. 14, and measuring frequency characteristics of the circularly polarized antenna gain in order to verify that a sharp notch is provided in antenna gain according to the principle as described above.

As is clear from FIG. 18A, it can be understood that the gain is maintained to be greater than or equal to 14 dBi over a range of 24 to 30 GHz, and a sharp notch which is declined 20 dB from the peak in the vicinity of 23.2 GHz is brought about.

However, in the circularly polarized antenna, a frequency of the notch is not completely matched to the RR prohibited band (23.6 to 24.0 GHz).

Figure 18B:
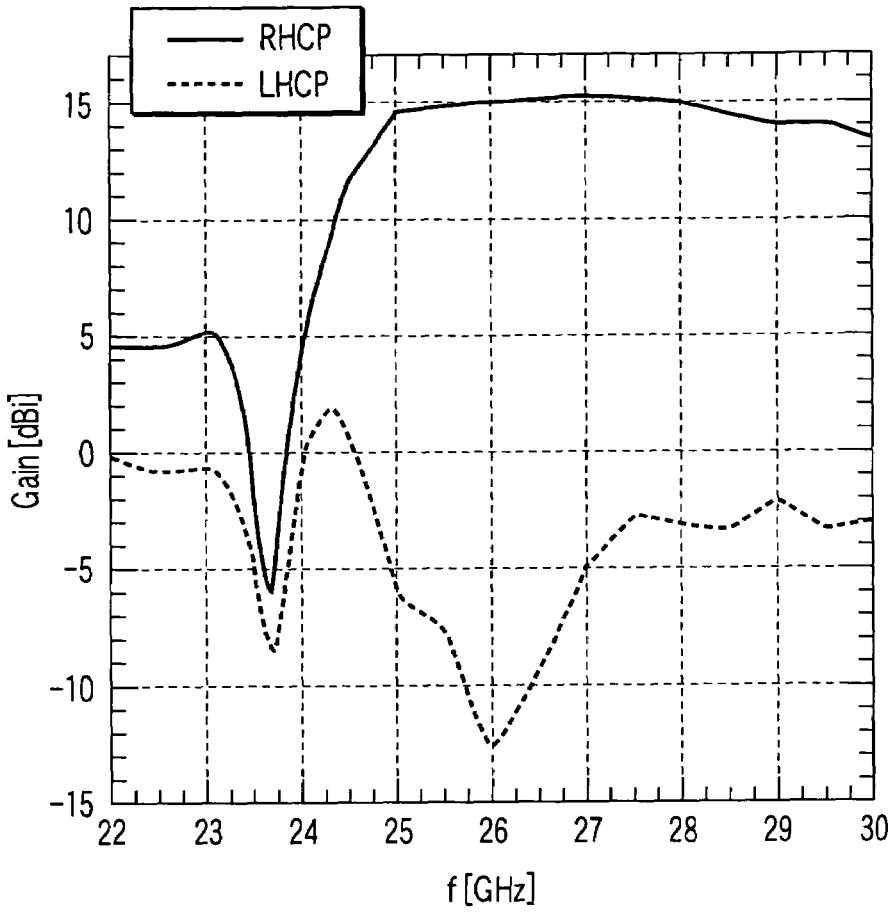
FIG. 18B is a graph for explaining in more detail a gain profile of the circularly polarized antenna configured such that a resonant frequency of the resonator is within the RR prohibited band in the configuration of the sequential rotation array to which the third embodiment of the circularly polarized antenna according to the invention is applied.

FIG. 18B is a graph showing results of newly experimentally manufacturing a circularly polarized antenna whose rim width $L_R$ is adjusted such that a frequency of the notch is matched to the RR prohibited band, and measuring frequency characteristics of circularly polarized antenna gain.

As the configuration of the circularly polarized antenna, the main polarization is right-hand circular polarization (RHCP), and the cross polarization is left-hand circular polarization (LHCP).

As is clear from FIG. 18B, it can be confirmed that the gain of the main polarization is maintained to be 14 dBi or more over a range of 25 to 29 GHz, and that there is a notch which is declined 10 dB or more from the peak gain in the RR prohibited band.

In this manner, in the circularly polarized antenna according to the invention, a frequency at which a notch is brought about can be easily matched to the RR prohibited band described above by appropriately selecting structural parameters of either the resonator or the spiral type antenna elements, or both of them.

In addition to the basic configuration described above, the circularly polarized antenna according to the invention has the following feature. Preferably, the antenna element has a predetermined polarization rotation direction, and is formed of a square-shaped spiral type or a circular spiral type having a central side end portion of a spiral. In the antenna element, a feed pin 25 whose one end side is connected to the central side end portion of the spiral of the antenna element formed of the square-shaped spiral type or circular spiral type, the feed pin 25 being provided so as to penetrate the dielectric substrate and the ground conductor. The antenna element which is formed on the dielectric substrate and the feed pin whose one end side is connected to the central side end portion of the spiral of the antenna element are provided to be respectively in plural sets. The predetermined polarization rotation directions of the plural sets of antenna elements are respectively formed so as to be identical polarization rotation direction. The plurality of metal posts configuring the cavities and the conducting rim are formed in a lattice shape so as to surround the plural sets of antenna elements. There is further provided a feed unit 40 to distribute and supply excitation signals to the plural sets of antenna elements via the plural sets of feed pins, the feed unit being provided at a side of the ground conductor.

In addition to the basic configuration described above, the circularly polarized antenna according to the present invention is characterized in that, preferably, the feed unit is configured by the feeding dielectric substrate 41 provided at a side opposite to the dielectric substrate so as to sandwich the ground conductor, and the microstrip type feeding line 42 formed on the surface of the feeding dielectric substrate 41.

In addition to the basic configuration described above, the circularly polarized antenna according to the present invention has the following feature. Preferably, the plural sets of antenna elements are formed so as to have at least two types of different array angles of identical array angle and different array angles from one another respectively around axes perpendicular to the opposite surface of the dielectric substrate. Among the plural sets of antenna elements, the feed unit distributes and supplies the excitation signals among the respective antenna elements having the identical array angle in-phase, and distributes and supplies the excitation signals among the respective antenna elements having the different array angles such that respective main polarization components are in-phase and respective cross polarization components are an out of phase.

In addition to the basic configuration described above, the circularly polarized antenna according to the present invention is characterized in that, preferably, the antenna element which is formed of the square-shaped spiral type is formed as a square-shaped spiral type of antenna element with a predetermined number of turns which are interlinked with one another in a square-shaped spiral form configured such that a basic length is made to be a0 with a predetermined element width W, and lines having lengths of the a0 and integer multiples of the a0 are arranged at each angle of 90°.

In addition to the basic configuration described above, the circularly polarized antenna according to the present invention is characterized in that, preferably, the antenna element which is formed of the circular spiral type is formed as a circular spiral type of antenna element having a predetermined number of turns which are interlinked with one another in a circular spiral form with a predetermined element width W at a predetermined spiral interval d, and with a predetermined radius initial value SR from a reference point.

In addition to the basic configuration described above, the circularly polarized antenna according to the present invention has the following feature. Preferably, the resonator is configured by the cavity and the conducting rim, and a frequency characteristic is provided in which the gain of the circularly polarized antenna declines within a predetermined range by setting a resonant frequency of the resonator to a desired value by adjusting structural parameters of the resonator and the antenna element.

In addition to the basic configuration described above, the circularly polarized antenna according to the present invention is characterized in that, preferably, the structural parameters include at least one of an inside dimension Lw of the cavity, a rim width $L_R$ of the conducting rim, the number of turns of the antenna element, a basic length a0 of the antenna element, and a line width W of the antenna element.

Seventh Embodiment

Figure 19:
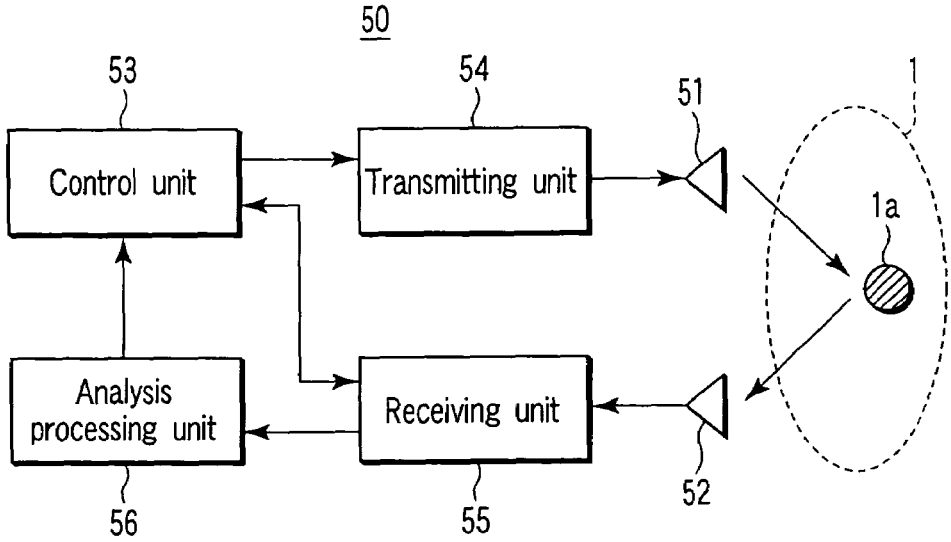
FIG. 19 is a block diagram for explaining a configuration of a radar device to which a seventh embodiment according to the present invention is applied.

FIG. 19 is a block diagram for explaining a configuration of a radar device to which a seventh embodiment according to the present invention is applied.

Namely, FIG. 19 shows a configuration of a UWB radar device 50 using the circularly polarized antenna (20, 20'20") according to the respective embodiments described above as a transmitting antenna 51 and a receiving antenna 52.

The radar device 50 shown in FIG. 19 is an automotive radar device. A transmitting unit 54 which is under the timing control by a control unit 53 generates a pulse wave with a carrier frequency of 26 GHz at predetermined cycles to be radiated from the transmitting antenna 51 into a space 1 which is an object to be explored.

The pulse wave returned by reflecting on an object 1*a* in the space 1 is received at the receiving antenna 52, and a reception signal thereof is inputted to the receiving unit 55.

The receiving unit 55 carries out detection processing for a reception signal under the timing control by the control unit 53.

The signal obtained by the detection processing is output to an analysis processing unit 56, and analysis processing is carried out onto the space 1 which is an object to be explored and an analyzed result thereof is notified to the control unit 53 as needed.

As the transmitting antenna 51 and the receiving antenna 52 of the radar device 50 having such a configuration, the circularly polarized antennas 20, 20', and 20" according to the respective embodiments described above can be used.

However, in the case of using the above for automotive purpose, the transmitting antenna 51 and the receiving antenna 52 are preferably formed integrally.

Further, radio waves in circular polarizations have a characteristic that a polarization rotation direction is reversed by reflection. As a consequence, when the polarization rotation directions of the transmitting antenna and the receiving antenna are reversed, secondary reflective components (to be more exact, even-numbered order reflective components) are suppressed, so that selectivity for primary reflective components (to be more exact, odd-numbered order reflective components) can be made high.

As a result, false images generated by secondary reflection can be reduced.

Figure 20:
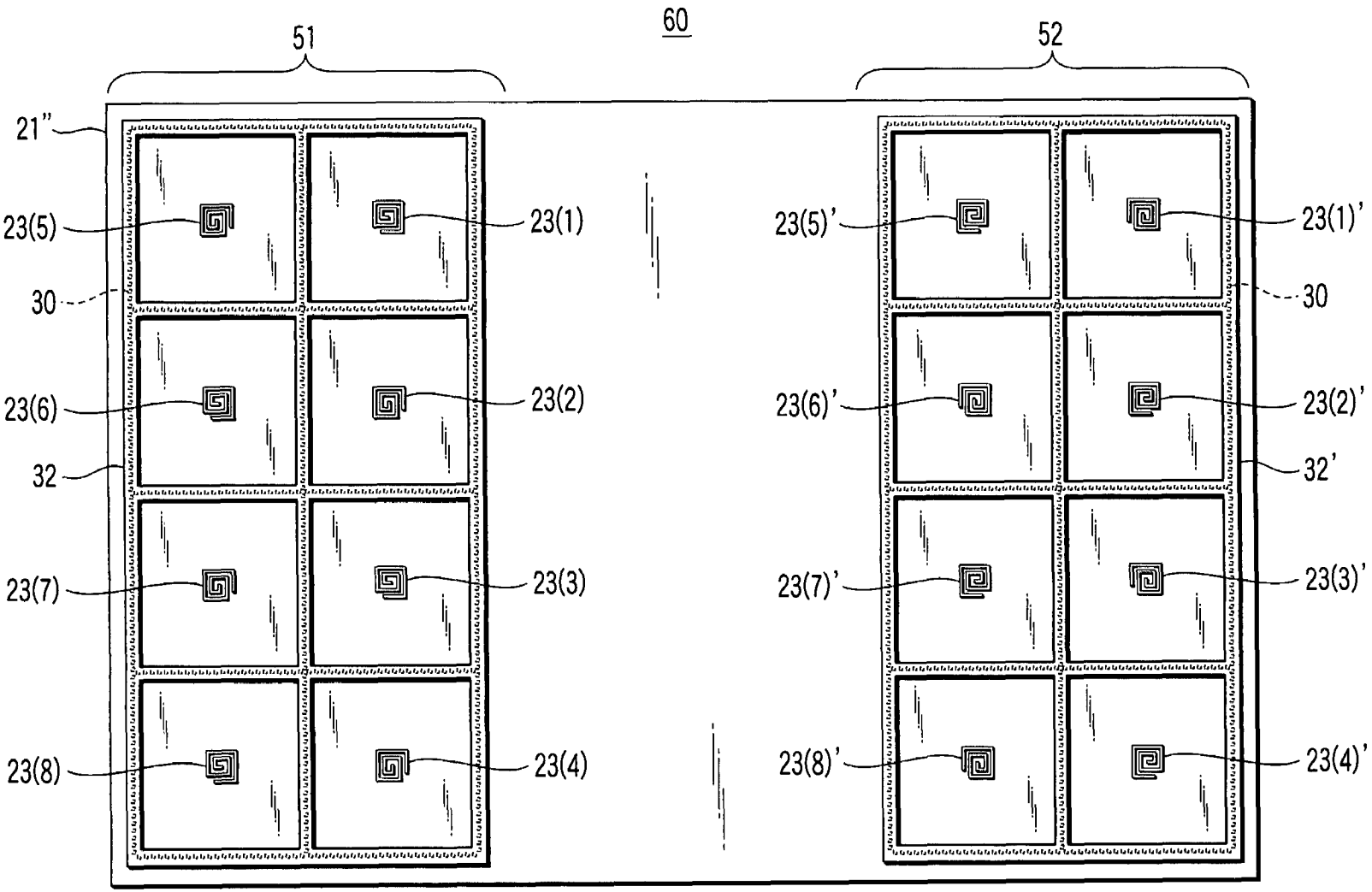
FIG. 20 is a front view for explaining a configuration of a circularly polarized antenna for use in the radar device to which the seventh embodiment according to the invention is applied.
Figure 21:
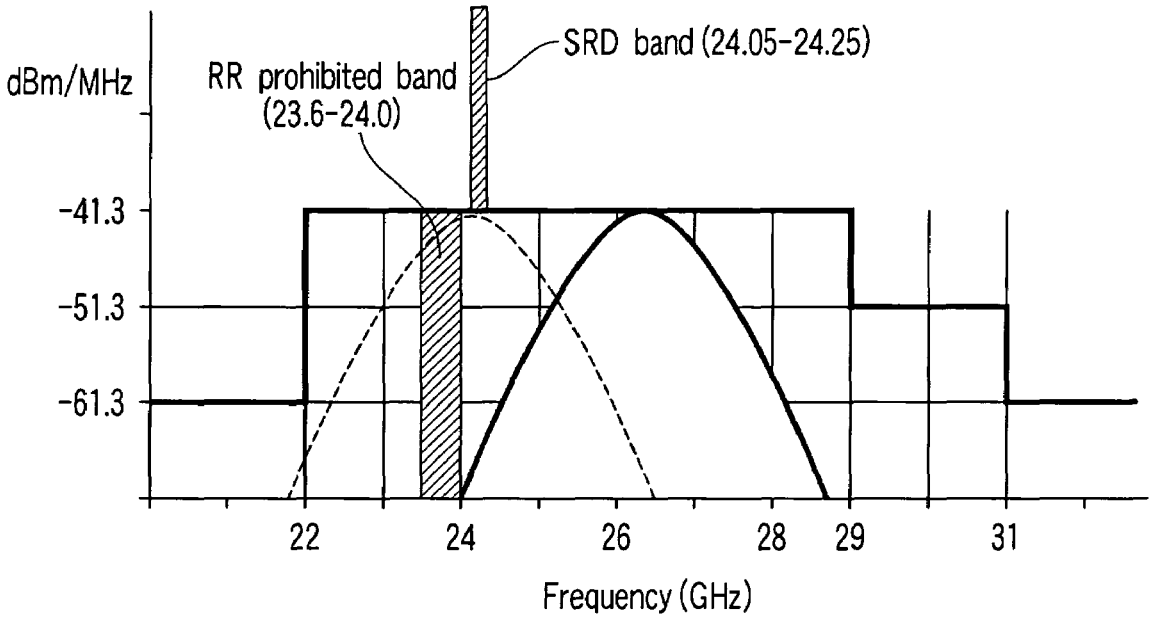
FIG. 21 (PRIOR ART)
FIG. 21 is a graph showing a spectrum mask of a quasi-millimeter waveband UWD and a desired usable frequency band.

FIG. 20 is a circularly polarized antenna 60 taking the above-described points into consideration, in which the transmitting antenna 51 and the receiving antenna 52 which structurally have identical configuration as the circularly polarized antenna 20' of FIG. 14 described above are respectively provided in the left and right of a lateral long like shaped of common dielectric substrate 21".

Namely, FIG. 20 is a front view for explaining a configuration of the circularly polarized antenna for use in a radar device to which the seventh embodiment according to the present invention is applied.

However, the respective antenna elements 23(1) to 23(8) of the transmitting antenna 51 on the left side are right-winded (left-hand polarization), and the respective antenna elements 23(1)' to 23(8)' of the receiving antenna 52 on the right side are left-winded (right-hand polarization).

The transmitting antenna 51 and the receiving antenna 52 provided at the circularly polarized antenna 60 are, as described above, free from the influence of a surface wave due to the respective antenna elements 23 being surrounded by the cavity configuration by the plurality of metal posts 30 and the conducting rim 32' as described above, and has a gain characteristic with a wideband which suppresses radiation to the RR prohibited band.

Additionally, the feed units (not shown) of the transmitting antenna 51 and the receiving antenna 52 which are shown in FIG. 17 are respectively made to have the sequential rotation array structures shown in FIG. 14 described above. Accordingly, the cross polarization components are balanced out to provide an substantially complete circular polarization characteristic. This makes it possible to receive a primary reflective wave with respect to the left-hand circular polarization radiated from the transmitting antenna 51 to the space to be explored with high sensitivity.

Incidentally, when the transmitting antenna 51 and the receiving antenna 52 are formed so as to be close to each other in this way, it can be thought that a radio wave radiated from the transmitting antenna 51 is directly input to the receiving antenna 52.

However, both of the transmitting antenna 51 and the receiving antenna 52 have substantially complete circular polarization characteristics due to the sequential rotation array structures described above, and the polarization rotation directions are opposite to each other. Consequently, direct input waves can be greatly reduced, which makes it possible to detect an object in the space to be explored with high sensitivity.

As the transmitting antenna 51 and the receiving antenna 52 of the radar device 50, antennas which are equivalent to the above circularly polarized antennas 20 and 20" may be used.

Namely, the radar device according to the present invention is characterized by basically including: the transmitting unit 54 which radiates a radar pulse into a space via the transmitting antenna 51; the receiving unit 55 which receives a reflected wave of the radar pulse returned from the space via the receiving antenna 52; the analysis processing unit 60 which explores an object existing in the space based on a reception output from the receiving unit; and the control unit 53 which controls at least one of the transmitting unit and the receiving unit based on an output from the analysis processing unit. In the radar device, the receiving antenna and the transmitting antenna are configured by first circularly polarized type of antenna elements (23, 23') having a predetermined polarization rotation direction, and second circularly polarized type of antenna elements (23', 23) having a polarization rotation direction in a direction opposite to the predetermined polarization rotation direction. The first and second circularly polarized type of antenna elements each have: the dielectric substrate 21, 21' and 21"; the ground conductor 22 and 22' which is piled up one surface side of the dielectric substrate; the circularly polarized type of antenna elements 23 and 23' formed onto the opposite surfaces of the dielectric substrates; the plurality of metal posts 30 whose respective one end sides are connected to the ground conductor and penetrate the dielectric substrate along a thickness direction thereof, and whose respective other end sides extend up to the opposite surfaces of the dielectric substrates, the plurality of metal posts 30 configuring cavities by being provided at predetermined intervals so as to surround the antenna elements; and the conducting rims 32 and 32' which short-circuit the respective other end sides of the plurality of metal posts along the array direction, and is provided so as to extend by a predetermined distance in the directions of the antenna elements at the opposite surface sides of the dielectric substrates. The plurality of metal posts 30, whose respective one end sides are connected to the ground conductors and penetrate the dielectric substrates along a thickness direction thereof, and whose respective other end sides extend up to the opposite surfaces of the dielectric substrates, respectively configure isolated cavities by being provided at predetermined intervals so as to surround the first circularly polarized type of antenna elements and the second circularly polarized type of antenna elements in isolation. As the conducting rims 32 and 32', the first conducting rim 32 and the second conducting rim 32' which short-circuit the respective other end sides of the plurality of metal posts which are respectively provided at predetermined intervals so as to surround the first circularly polarized type of antenna elements and the second circularly polarized type of antenna elements in isolation along array directions thereof, are provided on the opposite surface sides of the dielectric substrates so as to extend by a predetermined distance in the directions of the first circularly polarized type of antenna elements and the second circularly polarized type of antenna elements.

In addition to the basic configuration described above, the radar device according to the present invention has the following feature. Preferably, the antenna element has a predetermined polarization rotation direction, and is formed of a square-shaped spiral type or a circular spiral type having a central side end portion of a spiral. In the antenna element, a feed pin 25 whose one end side is connected to the central side end portion of the spiral of the antenna element formed of the square-shaped spiral type or circular spiral type, the feed pin being provided so as to penetrate the dielectric substrate and the ground conductor. The antenna element which is formed on the dielectric substrate and the feed pin whose one end side is connected to the central side end portion of the spiral of the antenna element are provided to be respectively in plural sets. The predetermined polarization rotation directions of the plural sets of antenna elements are respectively formed so as to be of the same polarization rotation direction. The plurality of metal posts configuring the cavities and the conducting rim are formed in a lattice shape so as to surround the plural sets of antenna elements. There is further provided a feed unit 40 to distribute and supply excitation signals to the plural sets of antenna elements via the plural sets of feed pins, the feed unit being provided at a side of the ground conductor.

In addition to the basic configuration described above, the radar device according to the present invention is characterized in that, preferably, the feed unit is configured by the feeding dielectric substrate 41 provided at a side opposite to the dielectric substrate so as to sandwich the ground conductor, and the microstrip type feeding line 42 formed on the surface of the feeding dielectric substrate 41.

In addition to the basic configuration described above, the radar device according to the present invention has the following feature. Preferably, the plural sets of antenna elements are formed so as to have at least two types of different array angles of identical array angle and different array angles from one another respectively around axes perpendicular to the opposite surface of the dielectric substrate. Among the plural sets of antenna elements, the feed unit distributes and supplies the excitation signals among the respective antenna elements having the identical array angle in-phase, and distributes and supplies the excitation signals among the respective antenna elements having different array angles such that respective main polarization components are in-phase and respective cross polarization components are out of phase.

In addition to the basic configuration described above, the radar device according to the present invention is characterized in that, preferably, the antenna element which is formed of the square-shaped spiral type is formed as a square-shaped spiral type of antenna element with a predetermined number of turns which are interlinked with one another in a square-shaped spiral form configured such that a basic length is made to be a0 with a predetermined element width W, and lines having lengths of the a0 and integer multiples of the a0 are arranged at each angle of 90°.

In addition to the basic configuration described above, the radar device according to the present invention is characterized in that, preferably, the antenna element which is formed of the circular spiral type is formed as a circular spiral type of antenna element having a predetermined number of turns which are interlinked with one another in a circular spiral form with a predetermined element width W at a predetermined spiral interval d, and with a predetermined radius initial value SR from a reference point.

In addition to the basic configuration described above, the radar device according to the present invention has the following feature. Preferably, the radar device is configured such that the resonator is configured by the cavities and the conducting rim. Structural parameters of the resonator and the antenna elements are adjusted to set a resonant frequency of the resonator to a desired value, thereby obtaining a frequency characteristic in which the gain of the circularly polarized antenna declines within a predetermined range.

In addition to the basic configuration described above, the radar device according to the present invention is characterized in that, preferably, the structural parameters include at least one of an inside dimension Lw of the cavity, a rim width $L_R$ of the conducting rim, the number of turns of the antenna element, a basic length a0 of the antenna element, and a line width W of the antenna element.

In addition to the basic configuration of the circular polarized antenna, the circular polarized antenna according to the present invention has the following feature. Preferably, as the antenna element, the first circularly polarized type of antenna elements 23 and 23' having a predetermined polarization rotation direction, and the second circularly polarized type of antenna elements 23' and 23 having a polarization rotation direction in a direction opposite to the predetermined polarization rotation direction are formed on the dielectric substrate 21". The plurality of metal posts 30, whose respective one end sides are connected to the ground conductor and penetrate the dielectric substrate along a thickness direction thereof, and whose respective other end sides extend up to the opposite surface of the dielectric substrate, respectively configure isolated cavities by being provided at predetermined intervals so as to surround the first circularly polarized type of antenna elements and the second circularly polarized type of antenna elements in isolation. As the conducting rim, the first conducting rim and the second conducting rim, which respectively short-circuit the respective other end sides of the plurality of metal posts respectively provided at predetermined intervals so as to surround the first circularly polarized type of antenna elements and the second circularly polarized type of antenna elements in isolation along array directions thereof, are provided on the opposite surface side of the dielectric substrate so as to extend by a predetermined distance in directions of the first circularly polarized type of antenna elements and the second circularly polarized type of antenna elements.

In addition to the basic configuration described above, the circular polarized antenna according to the present invention is characterized in that, preferably, one of the first circularly polarized type of antenna elements and the second circularly polarized type of antenna elements is applied as the transmitting antenna 51 of the radar device 50, and another of the first circularly polarized type of antenna elements and the second circularly polarized type of antenna elements is applied as the receiving antenna 52 of the radar device 50.

INDUSTRIAL APPLICABILITY

The above-described seventh embodiment is an example in which the circular polarized antennas according to the invention are used for a UWB radar device. However, the circular polarized antennas according to the invention can be applied to, not only UWB radar devices, but also various communication systems within a frequency band other than the UWB.

The invention claimed is:

1. A radar device comprising:

a transmitting unit which is configured to radiate a radar pulse into a space via a transmitting antenna;

a receiving unit which is configured to receive via a receiving antenna a reflected wave of the radar pulse returned from the space;

an analysis processing unit which explores an object existing in the space based on a reception output from the receiving unit; and a control unit which controls at least one of the transmitting unit and the receiving unit based on an output from the analysis processing unit, wherein each of the receiving antenna and the transmitting antenna comprises:

a dielectric substrate;

a ground conductor which is piled up at one surface side of the dielectric substrate;

circularly polarized antenna elements formed onto an opposite side of the dielectric substrate;

a plurality of metal posts which are arranged at predetermined intervals into a lattice structure to have cavities, the metal posts surrounding the antenna elements which are arranged in the cavities, respectively, wherein each of the metal posts has one and opposite ends, and penetrates the dielectric substrate along a thickness direction thereof, the one ends of the metal posts being connected to the ground conductor, and the opposite ends of the metal posts being arranged around the antenna elements on the opposite surface of the dielectric substrate; and a conducting rim which is extended along an arrangement of the opposite ends of the metal posts to define the cavities, and which is connected to the opposite ends of the metal posts to short-circuit the metal posts;

wherein the circularly polarized antenna elements for the receiving antenna are electrically isolated from the circularly polarized antenna elements for the transmitting antenna, and wherein the circularly polarized antenna elements for the receiving antenna have a first polarization rotation direction, and the circularly polarized antenna elements for the transmitting antenna have a second polarization rotation direction opposite to the first polarization rotation direction.

2. The radar device according to claim 1, wherein:

each of the antenna elements is formed of a square-shaped spiral type or a circular spiral type having a central end portion, and each of the receiving antenna and the transmitting antenna further comprises plural feed pins, each feed pin having one end connected to the central end portion of the corresponding antenna element, and wherein each of the feed pins is extended in the corresponding dielectric substrate and is so projected from the one surface side of the corresponding dielectric substrate as to be electrically isolated from the corresponding ground conductor.

3. The radar device according to claim 2, further comprising:

a feed unit to distribute and supply excitation signals to antenna elements via respective feed pins, the feed unit being provided at a ground side.

4. The radar device according to claim 3, wherein the feed unit includes:

a feeding dielectric substrate provided at a side opposite to a given dielectric substrate so as to sandwich a given ground conductor, and a microstrip type of feeding line formed on a surface of the feeding dielectric substrate.

5. The radar device according to claim 3, wherein the antenna elements of each of the receiving antenna and the transmitting antenna comprise first and second antenna elements, and wherein:

the first antenna elements are arranged at a same first array angle around axes perpendicular to the opposite surface of the dielectric substrate, and the second antenna elements are arranged at second array angles different from the same first array angle around axes perpendicular to the opposite surface of the dielectric substrate, respectively, and the excitation signals include first and second excitation signals which are supplied to the first and second antenna elements through the respective feed pins, the first excitation signals exciting the first antenna elements to produce main polarization components which are in-phase and cross polarization components which are in-phase, and the second excitation signals exciting the second antenna elements to produce main polarization components which are in-phase and cross polarization components which are out-of-phase.

6. The radar device according to claim 2, wherein the antenna elements are formed in the square-shaped spiral with a predetermined number of turns interlinked with one another, each turn having a conductive line arranged at an angle of 90° and having a length of a0 or an integer multiple of a0, wherein a0 is a basic length having a predetermined element width W.

7. The radar device according to claim 2, wherein the antenna elements are formed in the circular spiral with a predetermined number of turns interlinked with one another, the circular spiral having a predetermined element width W at a predetermined spiral interval d, and a predetermined radius initial value SR from a reference point.

8. The radar device according to claim 1, wherein a given cavity and the corresponding conducting rim define a cavity configure resonator which is excited by the corresponding circularly polarized antenna at a predetermined resonant frequency, and wherein the corresponding circularly polarized antenna has a frequency characteristic which provides a sufficient antenna gain in an operation frequency band and a notch in which an antenna gain declines within a predetermined range that includes the resonant frequency.

9. The radar device according to claim 8, wherein the given cavity and the corresponding conducting rim have parameters, respectively, which provide the predetermined resonant frequency, parameters including at least one of an inside dimension $L_W$ of the given cavity, a rim width $L_R$ of the corresponding conducting rim, a number of turns of the corresponding antenna element, a basic length a0 of the corresponding antenna element, and a line width W of the corresponding antenna element.

10. A circularly polarized antenna comprising:

a dielectric substrate;

a ground conductor which is piled up at one surface side of the dielectric substrate;

a plurality of circularly polarized antenna elements which are arranged and formed on an opposite surface of the dielectric substrate, wherein the antenna elements have a same predetermined polarization rotation direction, and each of the antenna elements is formed into a square-shaped spiral or a circular spiral having a central end portion;

an array of metal posts which are arranged at predetermined intervals into a lattice structure to have cavities, the metal posts surrounding the antenna elements which are arranged in the cavities, respectively, wherein each of the metal posts has one and opposite ends, and penetrates the dielectric substrate along a thickness direction thereof, the one ends of the metal posts being connected to the ground conductor, and the opposite ends of the metal posts being arranged around the antenna elements on the opposite surface of the dielectric substrate;

a conducting rim which is extended along an arrangement of the opposite ends of the metal posts to define the cavities, and which is connected to the opposite ends of the metal posts to short-circuit the metal posts;

feed pins each having one end connected to the central end portion of the corresponding antenna element, wherein each of the feed pins is extended in the dielectric substrate and is so projected from the one surface side of the dielectric substrate as to be electrically isolated from the ground conductor;

a feeding dielectric substrate provided at a side opposite to the one surface side of the dielectric substrate so as to interpose the ground conductor between the feeding dielectric substrate and the dielectric substrate; and a microstrip feeding line which is formed on the feeding dielectric substrate and which is connected to the feed pins, wherein excitation signals are supplied to the antenna elements through the feeding line and the feed pins.

11. The circularly polarized antenna according to claim 10, wherein a given cavity and the conducting rim defines a cavity configure resonator which is excited by the circularly polarized antenna at a predetermined resonant frequency, and wherein the circularly polarized antenna has a frequency characteristic that provides a sufficient antenna gain in an operation frequency band and a notch in which an antenna gain declines within a predetermined range that includes the resonant frequency.

12. The circularly polarized antenna according to claim 11, wherein the given cavity and the conducting rim have parameters, respectively, which provide the predetermined resonant frequency, the parameters including at least one of an inside dimension $L_W$ of the given cavity, a rim width $L_R$ of the conducting rim, a number of turns of the corresponding antenna element, a basic length a0 of the corresponding antenna element, and a line width W of the corresponding antenna element.

13. A circularly polarized antenna comprising:

a dielectric substrate;

a ground conductor which is piled up at one surface side of the dielectric substrate;

a plurality of antenna elements which are arranged and formed on an opposite surface of the dielectric substrate, wherein each of the antenna elements is formed into a square-shaped spiral or a circular spiral having a central end portion, wherein the antenna elements include first and second groups of antenna elements, the antenna elements in the first group being arranged at a same first array angle around axes perpendicular to the opposite surface of the dielectric substrate and the antenna elements in the second group being arranged at second array angles different from the same first array angle around axes perpendicular to the opposite surface of the dielectric substrate, respectively;

an array of metal posts which are arranged at predetermined intervals into a lattice structure to have cavities, wherein the metal posts surround the antenna elements which are arranged in the cavities, respectively, and wherein each of the metal posts has one and opposite ends, and penetrates the dielectric substrate along a thickness direction thereof, the one ends of the metal posts being connected to the ground conductor, and the opposite ends of the metal posts being arranged around the antenna elements on the opposite surface of the dielectric substrate;

a conducting rim which is extended along an arrangement of the opposite ends of the metal posts to define the cavities, and which is connected to the opposite ends of the metal posts to short-circuit the metal posts;

feed pins each having one end connected to the central end portion of the corresponding antenna element, wherein each of the feed pins is extended in the dielectric substrate and is so projected from the one surface side of the dielectric substrate as to be electrically isolated form the ground conductor; and a feed unit configured to supply first and second excitation signals to the first and second groups of the antenna elements through the feed pins, wherein the first excitation signals excite the first group of the antenna elements to produce main polarization components which are in-phase and cross polarization components which are in-phase, and the second excitation signals excite the second group of the antenna elements to produce main polarization components which are in-phase and cross polarization components which are out-of-phase.

14. The circularly polarized antenna according to claim 13, wherein a given cavity and the conducting rim define a cavity configure resonator which is excited by the circularly polarized antenna at a predetermined resonant frequency, and wherein the circularly polarized antenna has a frequency characteristic which provides a sufficient antenna gain in an operation frequency band and a notch in which an antenna gain declines within a predetermined range that includes the resonant frequency.

15. The circularly polarized antenna according to claim 14, wherein the given cavity and the conducting rim have parameters, respectively, which provide the predetermined resonant frequency, the parameters including at least one of an inside dimension $L_W$ of the cavity, a rim width $L_R$ of the conducting rim, a number of turns of the corresponding antenna element, a basic length a0 of the corresponding antenna element, and a line width W of the corresponding antenna element.

16. A circularly polarized antenna comprising:

a dielectric substrate;

a ground conductor which is piled up at one surface side of the dielectric substrate;

a circularly polarized antenna element formed on an opposite surface of the dielectric substrate in a square-shaped spiral with a predetermined number of turns interlinked with one another, each turn having a conductive line arranged at an angle of 90° and having a length of a0 or an integer multiple of a0, wherein a0 is a basic length with a predetermined element width W;

an array of metal posts which are arranged at predetermined intervals, wherein the metal posts surround the antenna element to form a cavity, and wherein each of the metal posts has one and opposite ends, and penetrates the dielectric substrate along a thickness direction thereof, the one ends of the metal posts being connected to the ground conductor, and the opposite ends of the metal posts being arranged around the antenna element on the opposite surface of the dielectric substrate;

a conducting rim which is extended along an arrangement of the opposite ends of the metal posts to define the cavity, and which is connected to the opposite ends of the metal posts to short-circuit the metal posts; and a feed pin having one end connected to a central end portion of the antenna element, wherein the feed pin is extended in the dielectric substrate and is so projected from the one surface side of the dielectric substrate as to be electrically isolated from the ground conductor.

17. The circularly polarized antenna according to claim 16, wherein the cavity and the conducting rim define a cavity configure resonator which is excited by the circularly polarized antenna at a predetermined resonant frequency, and wherein the circularly polarized antenna has a frequency characteristic which provides a sufficient antenna gain in an operation frequency band and a notch in which an antenna gain declines within a predetermined range that includes the resonant frequency.

18. The circularly polarized antenna according to claim 17, wherein the cavity and the conducting rim have parameters, respectively, which provide the predetermined resonant frequency, the parameters including at least one of an inside dimension $L_W$ of the cavity, a rim width $L_R$ of the conducting rim, the number of turns of the antenna element, the basic length a0 of the antenna element, and the width W of the antenna element.

19. A circularly polarized antenna comprising:

a dielectric substrate;

a ground conductor which is piled up at one surface side of the dielectric substrate;

first and second circularly polarized antenna elements formed on an opposite surface of the dielectric substrate, wherein the first circularly polarized antenna element has a first polarization rotation direction, and the second circularly polarized antenna element has a second polarization rotation direction opposite to the first polarization rotation direction;

arrays of metal posts which are arranged at predetermined intervals into a structure to have cavities, wherein the metal posts surround the first and second antenna elements which are arranged in the cavities, respectively, and which are isolated from each other by the metal posts, and wherein each of the metal posts has one and opposite ends, and penetrates the dielectric substrate along a thickness direction thereof, the one ends of the metal posts being connected to ground, and the opposite ends of the arrays of the metal posts being arranged around the respective antenna elements on the opposite surface of the dielectric substrate; and conducting rims which are extended along an arrangement of the opposite ends of the respective arrays of the metal posts, and which are connected to the opposite ends of the respective arrays of the metal posts to short-circuit the respective arrays of the metal posts.

20. The circularly polarized antenna according to claim 19, wherein a given cavity and the corresponding conducting rim define a cavity configure resonator which is excited by the circularly polarized antenna at a predetermined resonant frequency, and wherein the circularly polarized antenna has a frequency characteristic which provides a sufficient antenna gain in an operation frequency band and a notch in which an antenna gain declines within a predetermined range that includes the resonant frequency.

21. The circularly polarized antenna according to claim 20, wherein the given cavity and the corresponding conducting rim have parameters, respectively, which provide the predetermined resonant frequency, the parameters including at least one of an inside dimension $L_W$ of the given cavity, a rim width $L_R$ of the corresponding conducting rim, a number of turns of the corresponding antenna element, a basic length a0 of the corresponding antenna element, and a line width W of the corresponding antenna element.

22. A circularly polarized antenna comprising:

a dielectric substrate;

a ground conductor which is piled up at one surface side of the dielectric substrate;

a transmitting antenna for a radar device which includes a first group of circularly polarized antenna elements;

a receiving antenna for the radar device which includes a second group of circularly polarized antenna elements, wherein the first and second groups of the circularly polarized antenna elements are formed on an opposite surface of the dielectric substrate, the first group of the circularly polarized antenna elements having a first polarization rotation direction, and the second group of the circularly polarized antenna elements having a second polarization rotation direction opposite to the first polarization rotation direction;

arrays of metal posts which are arranged at predetermined intervals into a structure to have cavities, the metal posts surrounding the antenna elements in the first and second groups which are arranged in the cavities, respectively, and which are isolated from each other by the metal posts, wherein each of the metal posts has one and opposite ends, and penetrates the dielectric substrate along a thickness direction thereof, the one ends of the metal posts being connected to ground, and the opposite ends of the arrays of the metal posts being arranged around the respective antenna elements on the opposite surface of the dielectric substrate; and conducting rims which are extended along an arrangement of the opposite ends of the respective arrays of the metal posts and which are connected to the opposite ends of the respective arrays of the metal posts to short-circuit the respective arrays of the metal posts.

23. The circularly polarized antenna according to claim 22, wherein a given cavity and the corresponding conducting rim define a cavity configure resonator which is excited by the circularly polarized antenna at a predetermined resonant frequency, and wherein the circularly polarized antenna has a frequency characteristic which provides a sufficient antenna gain in an operation frequency band and a notch in which an antenna gain declines within a predetermined range that includes the resonant frequency.

24. The circularly polarized antenna according to claim 23, wherein the given cavity and the corresponding conducting rim have parameters, respectively, which provide the predetermined resonant frequency, the parameters including at least one of an inside dimension $L_W$ of the given cavity, a rim width $L_R$ of the corresponding conducting rim, a number of turns of the corresponding antenna element, a basic length a0 of the corresponding antenna element, and a line width W of the corresponding antenna element.

* * * * *